US011279587B2

(12) United States Patent
Noso

(10) Patent No.: US 11,279,587 B2
(45) Date of Patent: Mar. 22, 2022

(54) POST-PROCESSING APPARATUS AND IMAGE FORMING APPARATUS INCLUDING THE SAME

(71) Applicant: KYOCERA Document Solutions Inc., Osaka (JP)

(72) Inventor: Terumitsu Noso, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/178,610

(22) Filed: Feb. 18, 2021

(65) Prior Publication Data

US 2021/0261378 A1 Aug. 26, 2021

(30) Foreign Application Priority Data

Feb. 25, 2020 (JP) ..... JP2020-029439

(51) Int. Cl.
*B65H 37/04* (2006.01)
*G03G 15/00* (2006.01)

(52) U.S. Cl.
CPC ..... *B65H 37/04* (2013.01); *B65H 2408/122* (2013.01); *G03G 15/6544* (2013.01); *G03G 2215/00827* (2013.01)

(58) Field of Classification Search
None
See application file for complete search history.

(56) References Cited

U.S. PATENT DOCUMENTS

| | | | | |
|---|---|---|---|---|
| 5,452,887 | A * | 9/1995 | Okumura | B42C 1/125 270/58.08 |
| 6,164,511 | A * | 12/2000 | Chung | B27F 7/006 227/111 |
| 8,474,808 | B2 * | 7/2013 | Matsuo | G03G 15/6544 270/58.08 |
| 8,613,382 | B2 * | 12/2013 | Jung | B27F 7/21 227/156 |
| 9,738,481 | B2 * | 8/2017 | Lee | B65H 37/04 |
| 10,059,025 | B2 * | 8/2018 | Baek | B31F 5/001 |
| 10,077,165 | B2 * | 9/2018 | Ahn | B41L 43/12 |
| 10,632,644 | B2 * | 4/2020 | Lee | B27F 7/17 |
| 10,654,240 | B2 * | 5/2020 | Takahashi | B42B 5/00 |
| 10,934,124 | B2 * | 3/2021 | Baek | B31F 5/001 |

FOREIGN PATENT DOCUMENTS

JP 2013-136429 7/2013

* cited by examiner

*Primary Examiner* — Leslie A Nicholson, III
(74) *Attorney, Agent, or Firm* — Lex IP Meister, PLLC

(57) ABSTRACT

A staple unit is secured to a second movable body that is provided on a first movable body so as to be swayed. The first movable body is moved linearly in a width direction of a bundle of sheets. The second movable body includes a first engagement member and a second engagement member, and the movement of the first engagement member and the second engagement member in accordance with the linear movement of the first movable body is guided by a parallel groove, a first sway groove, and a second sway groove of a posture control unit. The first engagement member is in constant contact with the first sway groove while the first engagement member moves in the first sway groove, and the second engagement member is in constant contact with the second sway groove while the second engagement member moves in the second sway groove.

8 Claims, 19 Drawing Sheets

POST-PROCESSING APPARATUS AND IMAGE FORMING APPARATUS INCLUDING THE SAME

INCORPORATION BY REFERENCE

This application is based upon, and claims the benefit of priority from, corresponding Japanese Patent Application No. 2020-029439 filed in the Japan Patent Office on Feb. 25, 2020, the entire contents of which are incorporated herein by reference.

BACKGROUND

Field of the Invention

The present disclosure relates to a post-processing apparatus that executes post-processing on a sheet and an image forming apparatus to which the post-processing apparatus is applied.

Description of Related Art

There are typically known post-processing apparatuses that, when a sheet having undergone image formation is discharged to a discharge tray, sequentially executes post-processing on a plurality of sheets and then aligns and discharges the sheets. Post-processing applied to sheets include stapling processing to staple a bundle of sheets, which includes a plurality of sheets.

SUMMARY

A post-processing apparatus according to one aspect of the present disclosure includes: a stack unit on which sheets are stacked and aligned to form a bundle of sheets; a base member that is arranged adjacent to the stack unit; a first movable body that is supported by the base member and is linearly moved along a width direction of the bundle of sheets; a second movable body that includes a first engagement member and a second engagement member and is provided for the first movable body so as to be swayed; a staple unit that is secured to the second movable body, is moved in the width direction in accordance with a linear movement of the first movable body, is swayed due to sway of the second movable body so as to execute parallel stapling to staple the bundle of sheets stacked on the stack unit at a specific position parallel to the width direction, and is swayed at a specific angle with respect to the width direction together with the second movable body so as to execute corner stapling to staple the bundle of sheets at a corner at a tilt with respect to the width direction; and a posture control unit that is formed in the base member and is engaged with the first engagement member and the second engagement member to guide a movement of the first engagement member and the second engagement member in accordance with a linear movement of the first movable body so as to control a posture of the second movable body. The posture control unit includes: a parallel groove that extends linearly along the width direction to guide a movement of the first engagement member and the second engagement member side by side in the width direction in accordance with a linear movement of the first movable body to maintain a posture of the second movable body at a parallel posture such that the staple unit is in a posture parallel to the width direction; and a first sway groove that is formed in an arc shape from a first end of the parallel groove with respect to the width direction and having a first end arc area to guide the second movable body to a first corner stapling position so that the staple unit may execute the corner stapling at a corner on a first side with respect to the width direction of the bundle of sheets, wherein the first sway groove guides the movement of the first engagement member in the first end arc area while the second engagement member moves in the parallel groove in accordance with a linear movement of the first movable body to the first side with respect to the width direction so that a posture of the second movable body is changed from the parallel posture to a first sway posture due to sway around the second engagement member in a first direction at the first corner stapling position. The first engagement member is in constant contact with the first sway groove while the first engagement member moves in the first sway groove.

DETAILED DESCRIPTION

A post-processing apparatus and an image forming apparatus according to an embodiment of the present disclosure are described below with reference to the drawings.

Figure 1:
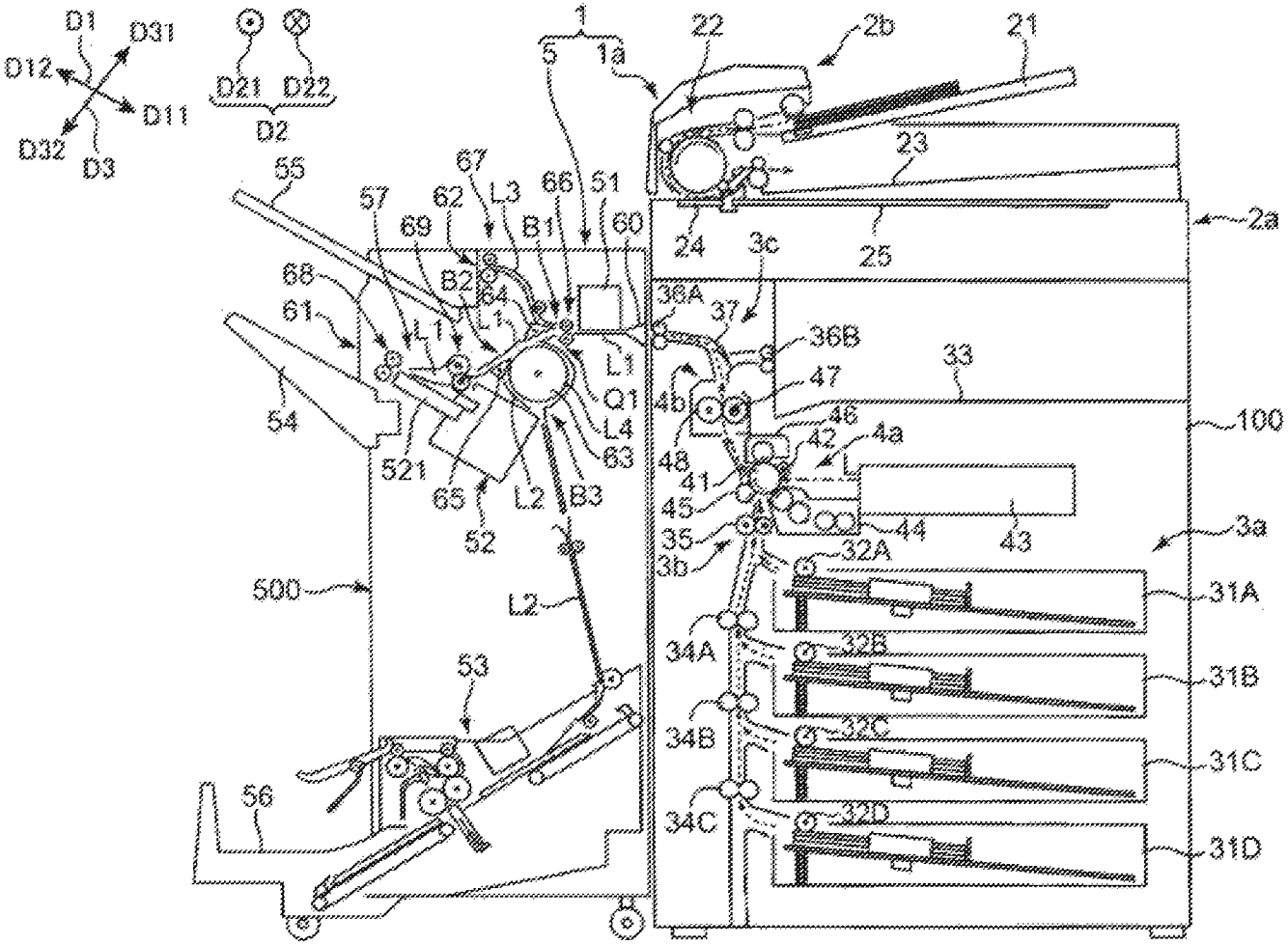
FIG. 1 is a cross-sectional view schematically illustrating an internal structure of an image forming apparatus including a post-processing apparatus according to an embodiment of the present disclosure.

FIG. 1 is a cross-sectional view schematically illustrating the internal structure of an image forming apparatus 1 including a post-processing apparatus 5 and a main body 1*a* according to an embodiment of the present disclosure. Although what is called an in-chassis sheet-discharge monochrome copier is illustrated here as the main body 1*a* of the image forming apparatus 1, the main body 1*a* may be a color copier, a printer, a fax machine, or a multifunction peripheral having these functions.

The image forming apparatus 1 includes the main body 1*a* that performs image forming processing on a sheet and the post-processing apparatus 5 located adjacent to the main body 1*a* and including a post-processing unit that performs specific post-processing on a sheet or a bundle of sheets, which includes a plurality of sheets, having undergone image forming processing. Examples of the post-processing include punching processing to punch a sheet for stapling, stapling processing to staple a bundle of sheets, center-folding processing to fold a sheet, and alignment processing to perform a shift operation or a width adjustment operation for a sheet.

The main body 1*a* includes a main body chassis 100, an image reading unit 2*a* located in the upper portion of the main body chassis 100, and an automatic document feeder (ADF) 2*b* located on the top of the image reading unit 2*a*. A sheet feed unit 3*a*, a conveyance path 3*b*, an image forming unit 4*a*, a fixing unit 4*b*, and a sheet discharge unit 3*c* are housed inside the main body chassis 100.

The automatic document feeder 2*b* automatically feeds a document sheet to be copied toward a specific document read position (the position where a first platen 24 is assembled). In a case where the user manually places a document sheet at a specific document read position (the position where a second platen 25 is provided), the automatic document feeder 2*b* is opened upward. The automatic document feeder 2*b* includes a document tray 21 on which a document sheet is placed, a document conveying unit 22 that conveys a document sheet via the automatic document read position, and a document discharge tray 23 into which a read document sheet is discharged.

The image reading unit 2*a* has a box-shaped chassis structure and has the first platen 24 for reading a document sheet automatically fed by the automatic document feeder 2*b* and the second platen 25 for reading a manually placed document sheet fitted into the upper surface thereof. The image reading unit 2*a* optically reads the image of a document sheet.

The sheet feed unit 3*a* in the main body chassis 100 includes a plurality of cassettes 31 (31A, 31B, 31C, and 31D). The cassettes 31 include sheet feed rollers 32 (32A, 32B, 32C, and 32D), respectively, which are driven to rotate, and feed sheets one by one to the conveyance path 3*b* during image formation.

The conveyance path 3*b* is a conveyance path for conveying a sheet in the main body chassis 100 from the sheet feed unit 3*a* to an in-chassis discharge tray 33 or the post-processing apparatus 5. The conveyance path 3*b* is provided with a guide plate for guiding a sheet, a pair of conveyance rollers 34 (34A, 34B, and 34C) that is driven to rotate during sheet conveyance, and a pair of registration rollers 35 that causes a conveyed sheet to stand by in front of the image forming unit 4*a* and delivers the sheet in synchronized timing with the transfer of a formed toner image.

The image forming unit 4*a* generates a toner image and transfers the toner image onto a sheet, that is, forms an image on a sheet. The image forming unit 4*a* includes a photosensitive drum 41, a charger 42, an exposure device 43, a developing device 44, a transfer roller 45, and a cleaning device 46, which are provided around the photosensitive drum 41.

The photosensitive drum 41 rotates around its axis and has an electrostatic latent image and a toner image formed on its peripheral surface. The charger 42 uniformly charges the surface of the photosensitive drum 41. The exposure device 43 has a laser light source and optical devices, such as a mirror or a lens, and irradiates the peripheral surface of the photosensitive drum 41 with a laser light L based on the image data on a document image to generate an electrostatic latent image. The developing device 44 supplies toner to the peripheral surface of the photosensitive drum 41 to develop an electrostatic latent image formed on the photosensitive drum 41. The transfer roller 45 forms a transfer nip portion together with the photosensitive drum 41 and has a transfer bias applied thereto. A toner image on the photosensitive drum 41 is transferred onto a sheet passing through the transfer nip portion. The cleaning device 46 includes a cleaning roller, or the like, to clean the peripheral surface of the photosensitive drum 41 after the transfer of a toner image.

The fixing unit 4*b* fixes the toner image transferred onto a sheet. The fixing unit 4*b* includes a heating roller 47 including a built-in heat generator and a pressure roller 48 to be pressed against the heating roller 47. When the sheet having a toner image transferred thereon is passed through the fixing nip formed by the heating roller 47 and the pressure roller 48, the toner is melted and heated so that the toner image is fixed to the sheet. The sheet having undergone the fixing process is delivered to the sheet discharge unit 3*c*.

The sheet discharge unit 3*c* includes a pair of external discharge rollers 36A that delivers a sheet having an image formed thereon toward the post-processing apparatus 5 and a pair of internal discharge rollers 36B that delivers a sheet toward the in-chassis discharge tray 33. The pairs of discharge rollers 36A and 36B are driven to rotate during a discharge operation to discharge a sheet to outside of the apparatus. The sheet discharge unit 3*c* includes a switch lever 37 that switches the conveying direction of a sheet.

The post-processing apparatus 5 includes a post-processing apparatus chassis 500 located adjacent to the main body chassis 100 and a post-processing unit provided in the post-processing apparatus chassis 500. According to the present embodiment, a punching device 51, a stapling processing apparatus 52, a center-folding device 53, and an alignment unit 57 are provided as the post-processing unit. The punching device 51, the stapling processing apparatus 52, and the alignment unit 57 are housed near the upper portion of the post-processing apparatus chassis 500, and the center-folding device 53 is housed near the lower portion thereof.

The side surface of the post-processing apparatus chassis 500 opposed to the main body chassis 100 is provided with a receiving port 60 for receiving a sheet having undergone image formation processing into the post-processing apparatus chassis 500, and a side surface on the opposite side to the above side surface is provided with a main discharge port 61 and a sub discharge port 62 for discharging a sheet from the post-processing apparatus chassis 500. The post-processing apparatus chassis 500 is provided with a main discharge tray 54 and a sub discharge tray 55 corresponding to the main discharge port 61 and the sub discharge port 62, respectively. The post-processing apparatus chassis 500 further includes a first conveyance path L1, a second conveyance path L2, a third conveyance path L3, a fourth conveyance path L4, a first merging area Q1, a first branching area B1, a second branching area B2, a third branching area B3, and a retreat drum 63.

The first conveyance path L1 is a conveyance path for conveying a sheet, which is received through the receiving port 60, to the main discharge port 61. A sheet discharged through the main discharge port 61 is discharged onto the main discharge tray 54.

The third conveyance path L3 is formed by branching from the first conveyance path L1 at the first branching area B1. The third conveyance path L3 is a conveyance path from the first branching area B1 to the sub discharge port 62. A sheet discharged through the sub discharge port 62 is discharged onto the sub discharge tray 55.

The second conveyance path L2 is formed by branching from the first conveyance path L1 at the second branching area B2. The second conveyance path L2 is a conveyance path extending vertically to the center-folding device 53. The fourth conveyance path L4 is a conveyance path that branches from the second conveyance path L2 at the third branching area B3, curves along the circumference of the retreat drum 63, and merges with the first conveyance path L1 at the first merging area Q1.

A first switch claw 64 is provided in the first branching area B1. The first switch claw 64 switches the conveyance destination of a sheet conveyed through the first conveyance path L1 between the first conveyance path L1 as it is and the third conveyance path L3. A second switch claw 65 is provided in the second branching area B2. The second switch claw 65 switches the conveyance destination of a sheet between the first conveyance path L1 and the second conveyance path L2.

A pair of first conveyance rollers 66 is provided at a position adjacent to the first branching area B1 on the upstream side. A pair of fourth conveyance rollers 68 is provided at the downstream end of the first conveyance path L1 and near the main discharge port 61. A pair of second conveyance rollers 69 is provided on the upstream side of the pair of fourth conveyance rollers 68 on the first conveyance path L1. A sheet passing through the first conveyance path L1 is conveyed from the receiving port 60 to the main discharge port 61 and the main discharge tray 54 by the pair of first conveyance rollers 66, the pair of second conveyance rollers 69, and the pair of fourth conveyance rollers 68.

A pair of third conveyance rollers 67 is provided at the downstream end of the third conveyance path L3 and near the sub discharge port 62. A sheet conveyed through the third conveyance path L3 is discharged to the sub discharge tray 55 by the pair of third conveyance rollers 67.

The punching device 51 is provided on the entrance side of the first conveyance path L1. The punching device 51 performs punching processing to punch a sheet for stapling at specific timing. The punching device 51 performs punching processing on the rear end side of a sheet in the conveying direction. During the punching processing, a sheet is temporarily stopped.

The stapling processing apparatus 52 performs stapling processing to staple a bundle of sheets, which include a plurality of sheets. The stapling processing is processing to staple a bundle of sheets at a corner or an edge, what is called edge stapling. When stapling processing is executed, a sheet is conveyed along the first conveyance path L1 to the vicinity of the main discharge port 61 while the conveyance nip portion of the pair of fourth conveyance rollers 68 is canceled so that the sheet is conveyed and stacked on a staple tray 521. The bundle of sheets having undergone the stapling processing is discharged from the staple tray 521 to the main discharge tray 54 by the pair of fourth conveyance rollers 68 whose conveyance nip portion has been restored.

The center-folding device 53 staples a bundle of sheets near its center so as to perform central stapling and also folds the bundle of sheets at its center portion in half so as to perform center-folding processing. The sheets to be subjected to center-folding processing is guided from the first conveyance path L1 to the second conveyance path L2 via the second branching area B2 and is delivered into the center-folding device 53. The bundle of sheets having undergone center-folding processing is discharged onto a center-folding sheet discharge tray 56 provided in the lower portion of the post-processing apparatus chassis 500. The center-folding device 53 may exclusively perform the center-folding processing.

The alignment unit 57 performs alignment processing such as the shift operation to shift a sheet or a bundle of sheets in a sheet width direction that is perpendicular to the conveying direction of a sheet, and the width alignment operation to align the end edges of sheets in a bundle. When the stapling processing apparatus 52 performs stapling processing, the alignment unit 57 executes the shift operation or the width alignment operation to set the stapling position for a bundle of sheets. The alignment unit 57 is also used when a sheet is stacked on the main discharge tray 54 due to offset discharge even when the stapling processing is not performed. Offset discharge is that, for example, when multiple copies are made for one group of document sheets, which include a plurality of sheets, the edge position of the sheet group is shifted in the sheet width direction so as to be stacked in units of one copy of sheets in a group.

The main discharge tray 54 is a tray onto which a sheet or a bundle of sheets is discharged through the main discharge port 61 by the pair of fourth conveyance rollers 68 to be stacked after the stapling processing, the shift operation, and the width alignment operation are performed. The main discharge tray 54 is sequentially lowered from the highest position in accordance with an increase in the number of discharged sheets in a bundle and, when the bundle of sheets is removed from the main discharge tray 54, is left so as to be reset in the reference position. The sub discharge tray 55 is a tray onto which a sheet is discharged through the sub discharge port 62 by the pair of third conveyance rollers 67 so as to be stacked. On the sub discharge tray 55, primarily, a sheet discharged without any particular post-processing by the post-processing apparatus 5 or a sheet having undergone exclusively punching processing is stacked.

The retreat drum 63 has a peripheral surface and is driven to rotate in a specific rotational direction. In a case where stapling processing is continuously executed on multiple bundles of sheets, while a first bundle of sheets is subjected to stapling processing by the stapling processing apparatus 52, the retreat drum 63 causes the subsequent bundle of sheets to stand by with a first sheet wrapped around the surface of the retreat drum 63. This function of the retreat drum 63 eliminates the need to temporarily stop a sheet that is delivered from the main body 1*a* while stapling processing is performed, which improves the productivity.

Figure 2:
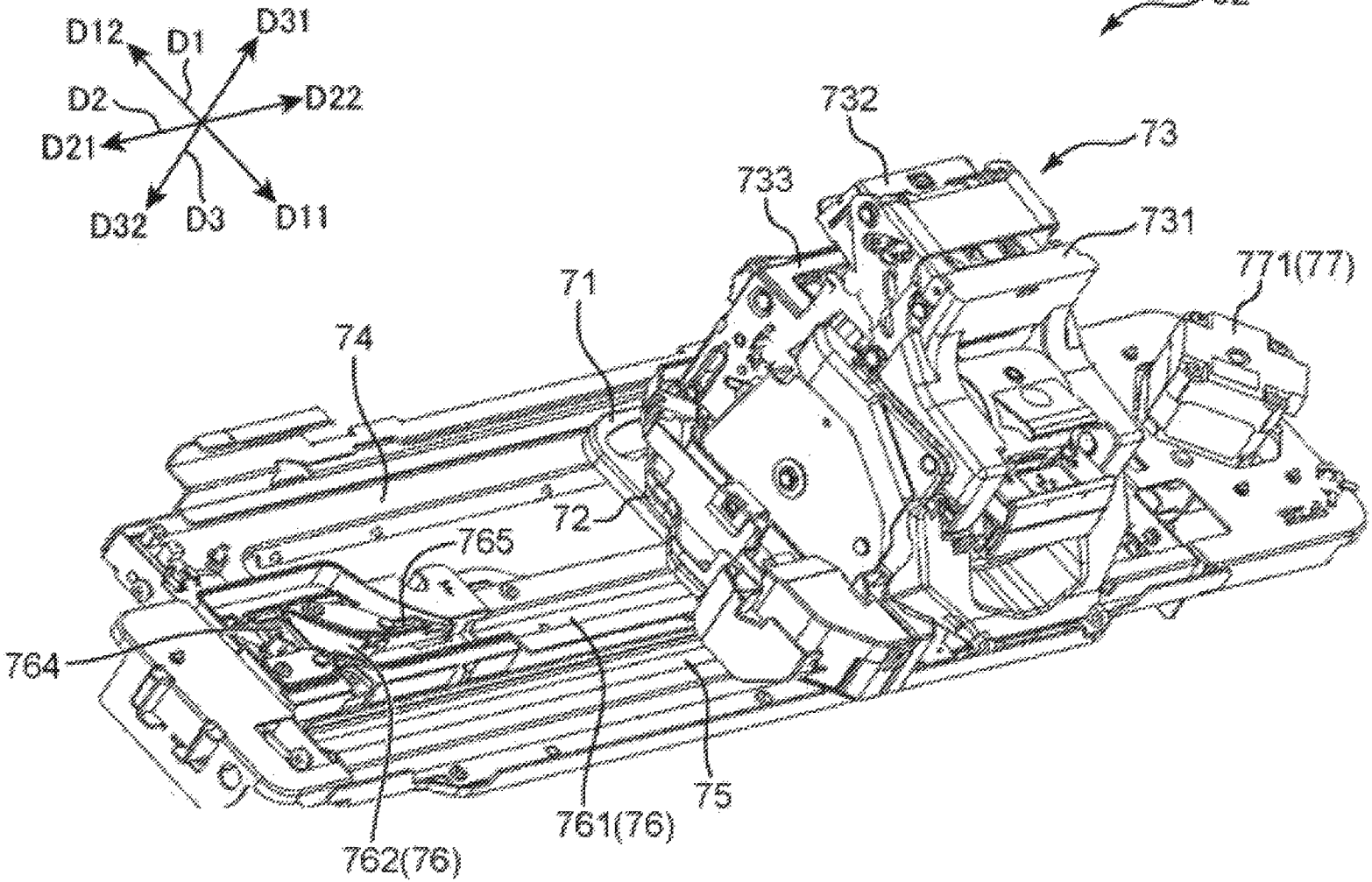
FIG. 2 is a perspective view illustrating a state where a staple unit of a stapling processing apparatus, which is a post-processing apparatus, is in a parallel posture.
Figure 3:
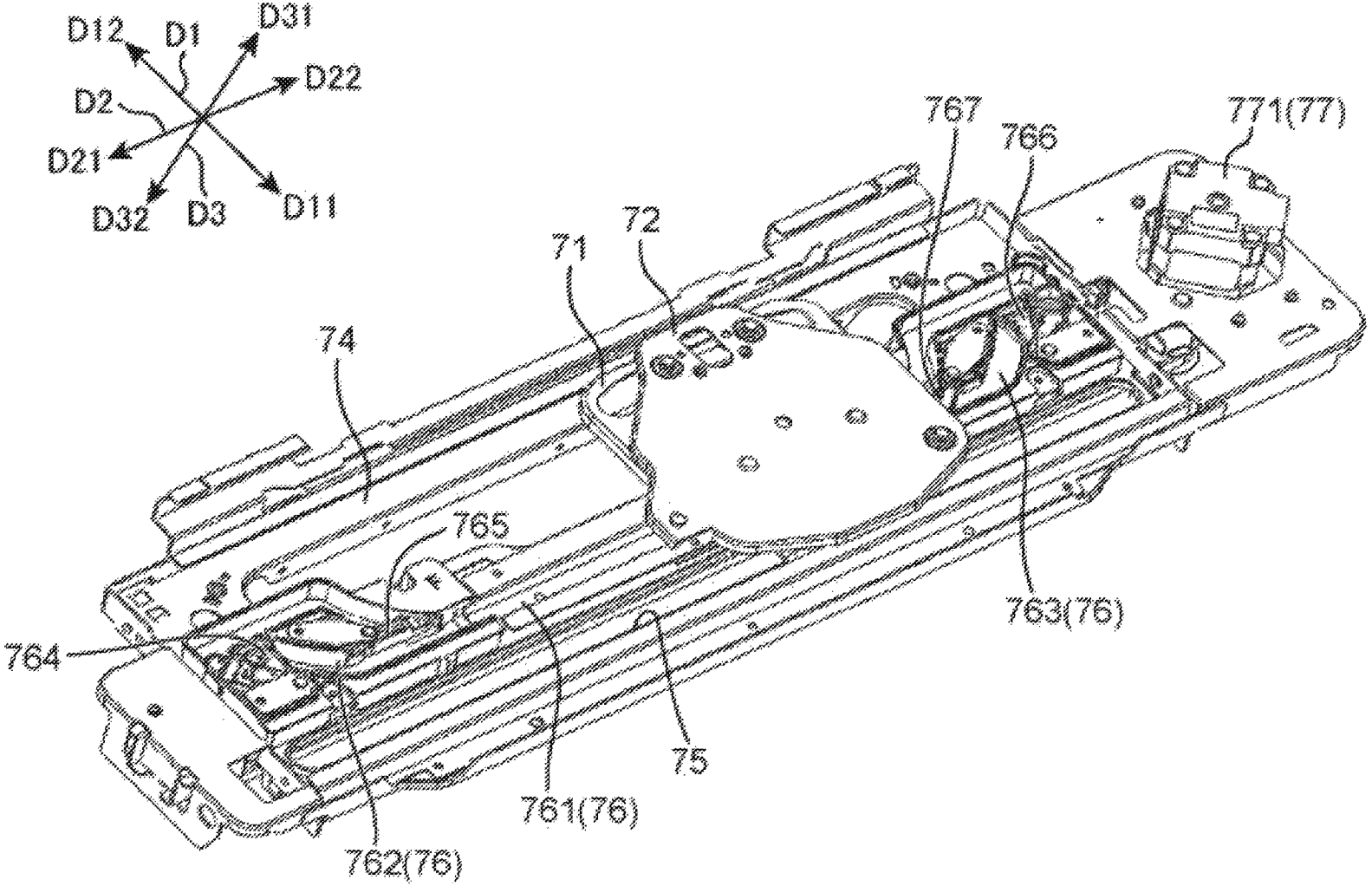
FIG. 3 is a perspective view illustrating the postures of a first movable body and a second movable body on a base member when the staple unit is in a parallel posture.
Figure 4:
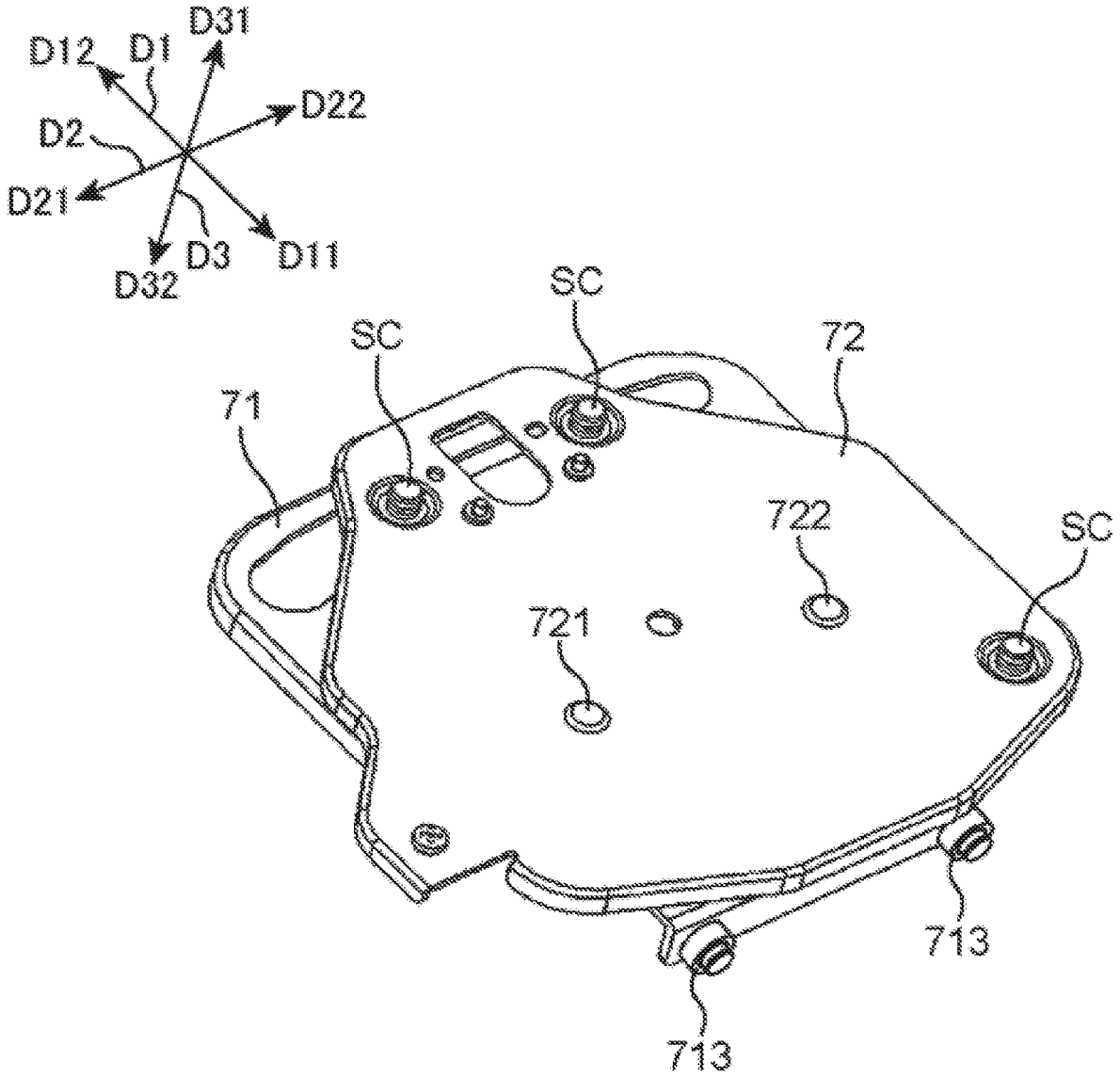
FIG. 4 is a perspective view of the first movable body and the second movable body illustrated in FIG. 3 as viewed from above.
Figure 5:
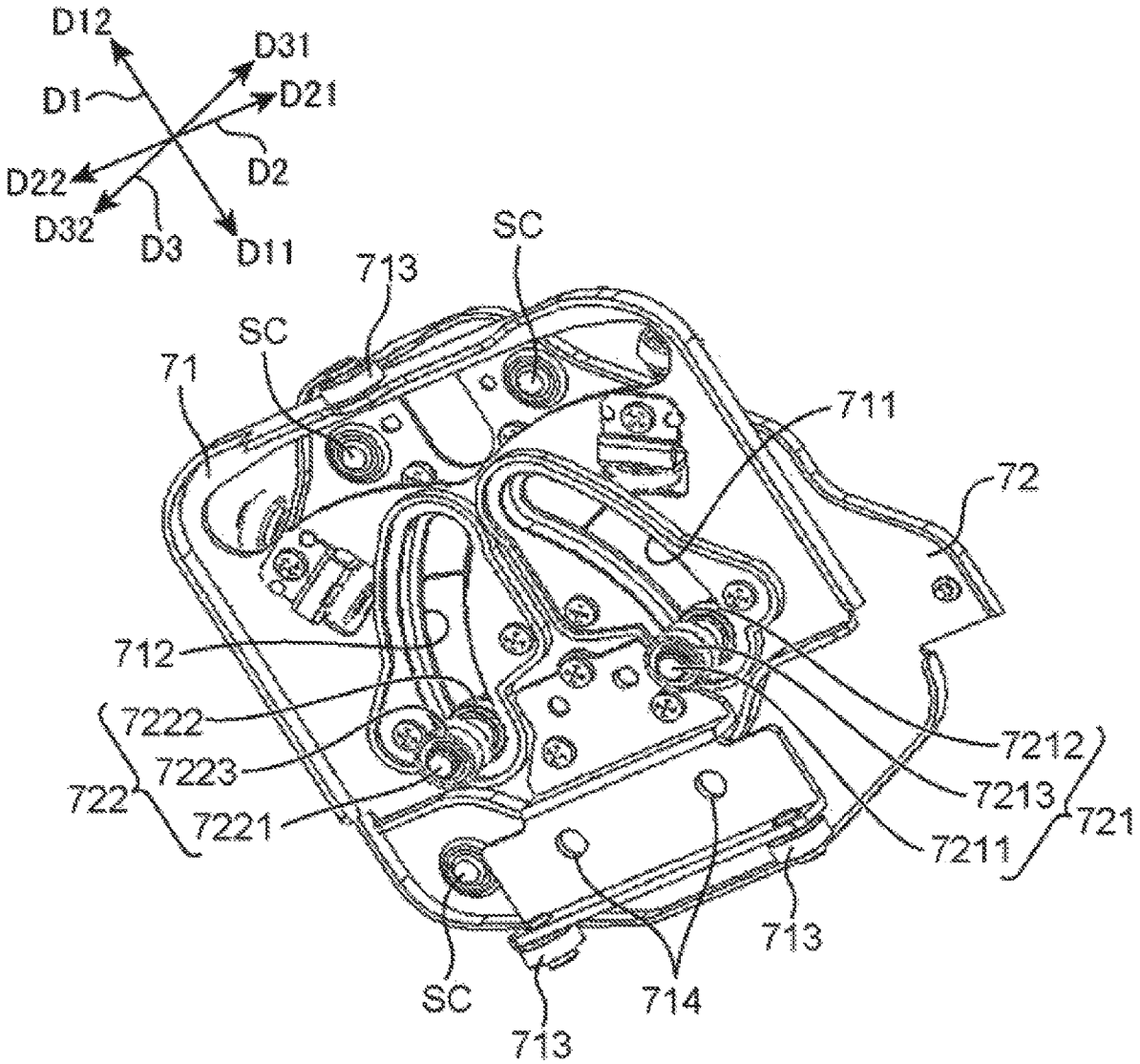
FIG. 5 is a perspective view of the first movable body and the second movable body illustrated in FIG. 3 as viewed from below.
Figure 6:
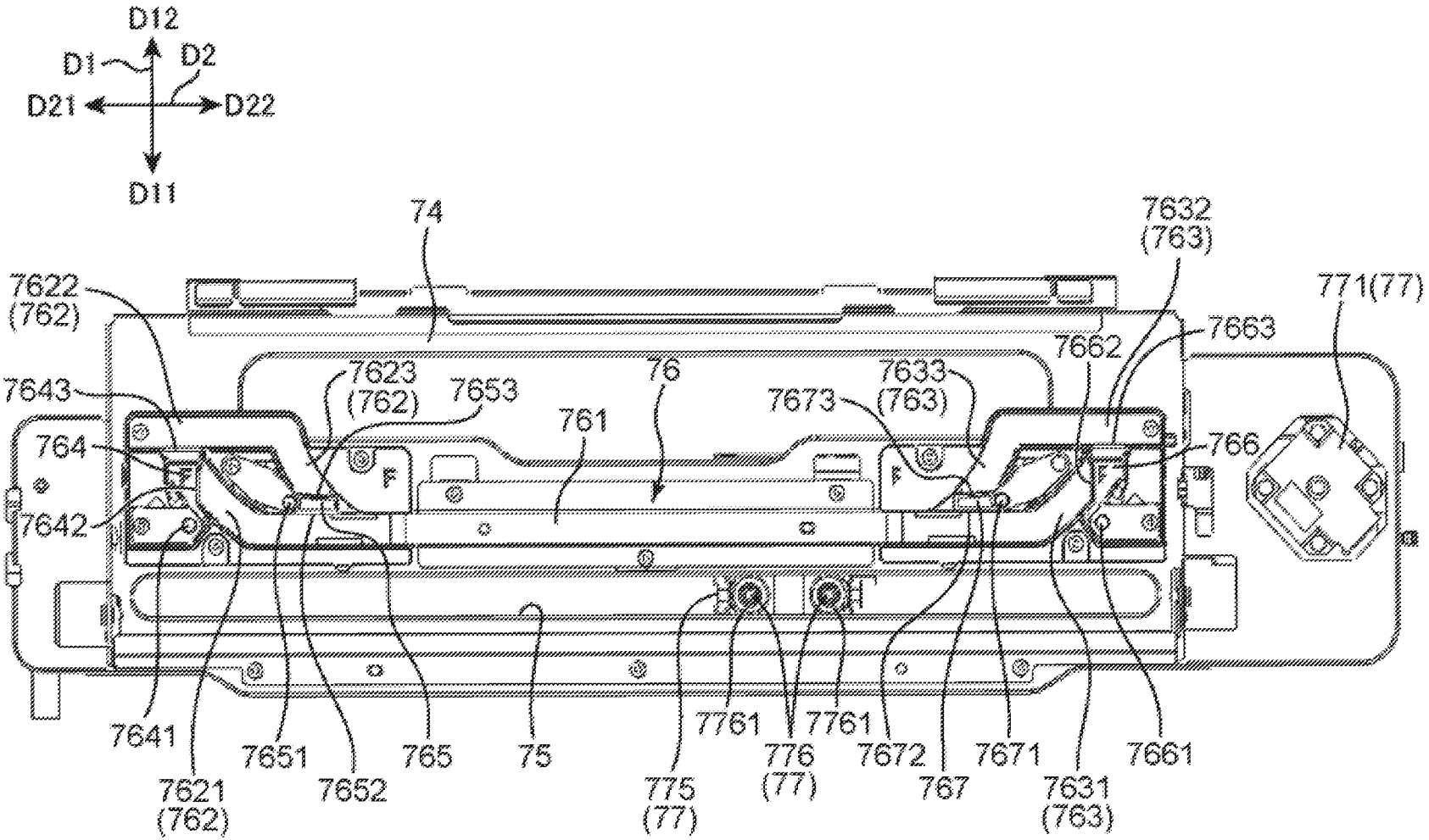
FIG. 6 is a plan view of the base member viewed from above.
Figure 7:
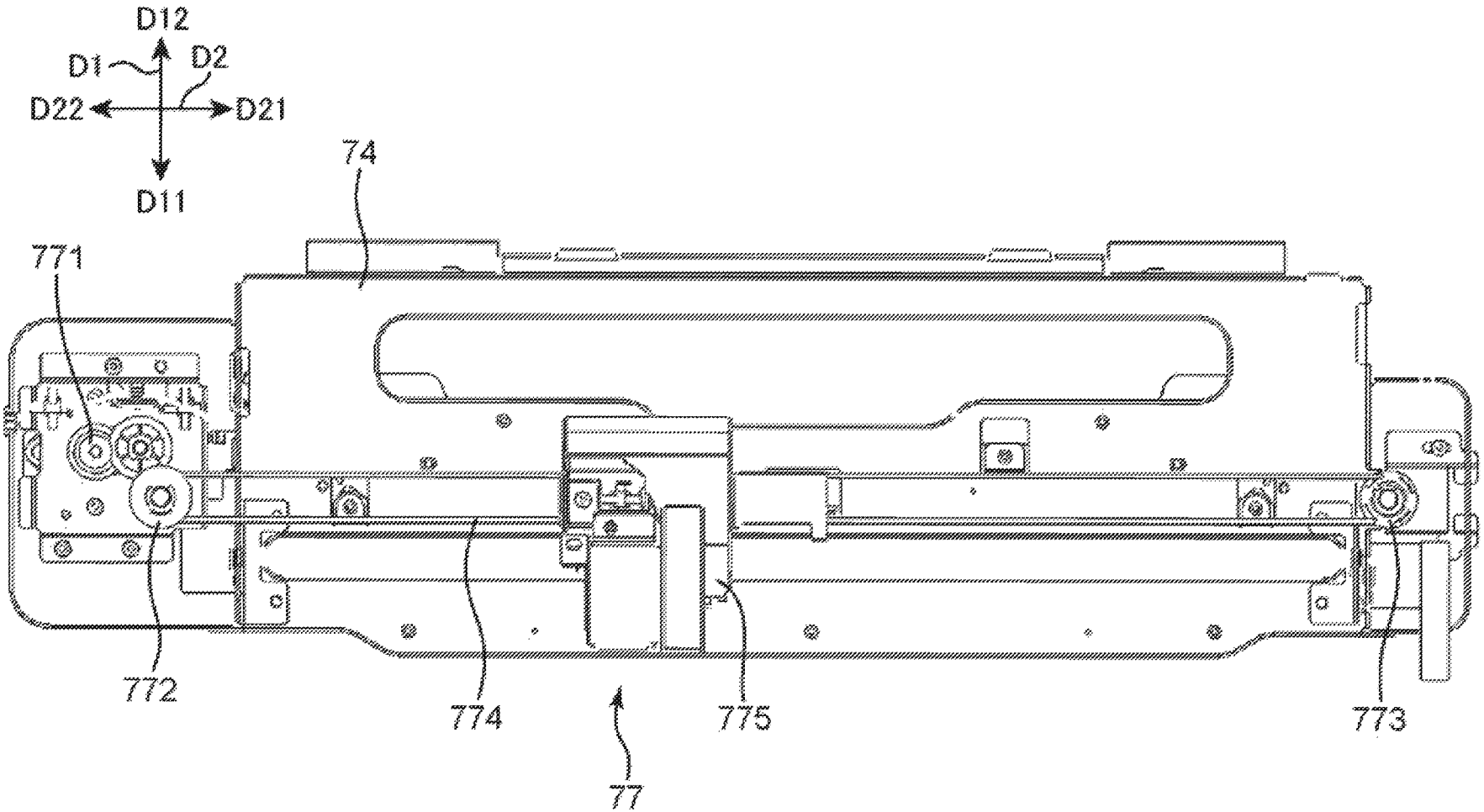
FIG. 7 is a plan view of the base member viewed from below.
Figure 8:
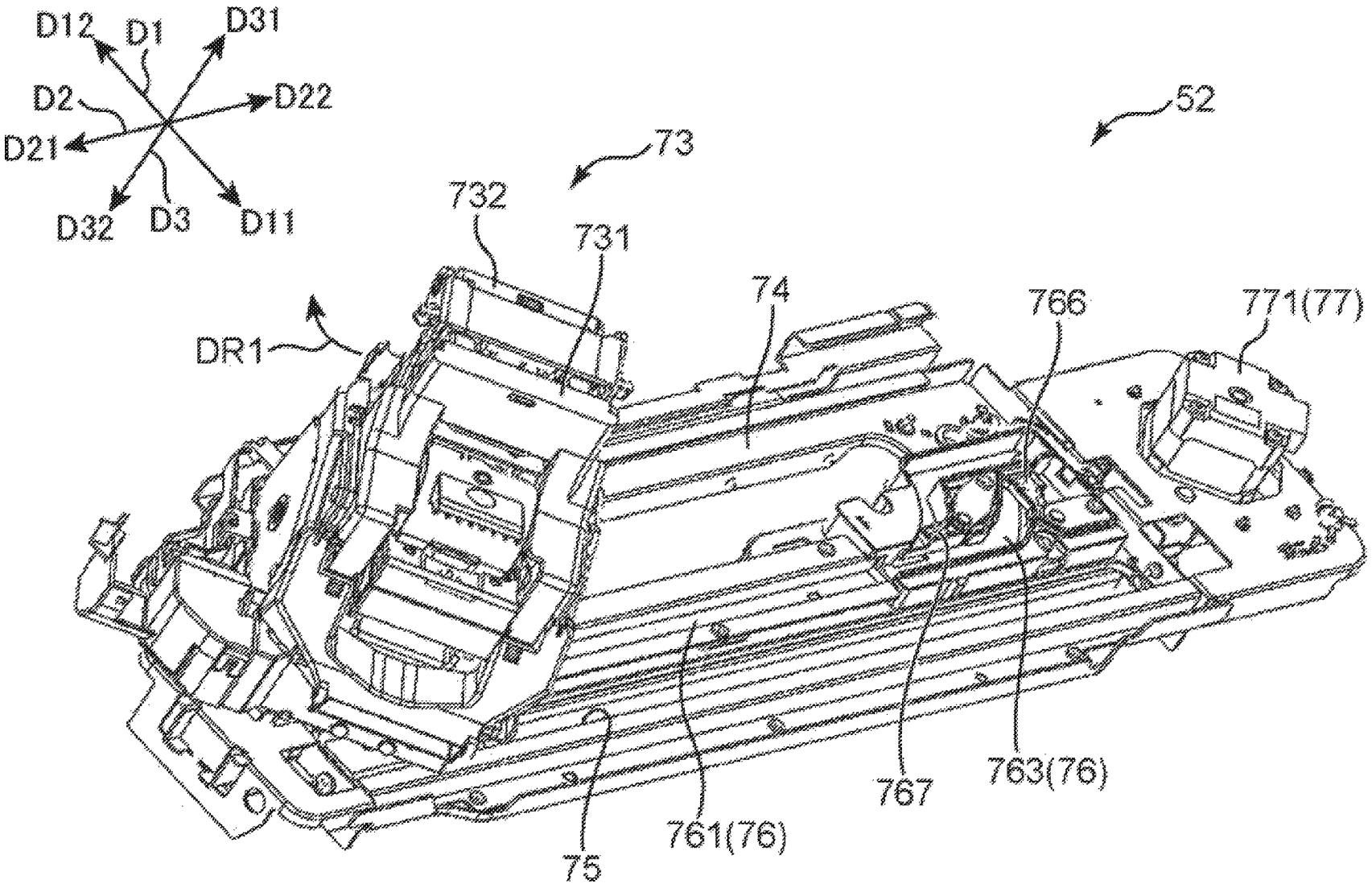
FIG. 8 is a perspective view illustrating a state where the staple unit is in a first sway posture.
Figure 9:
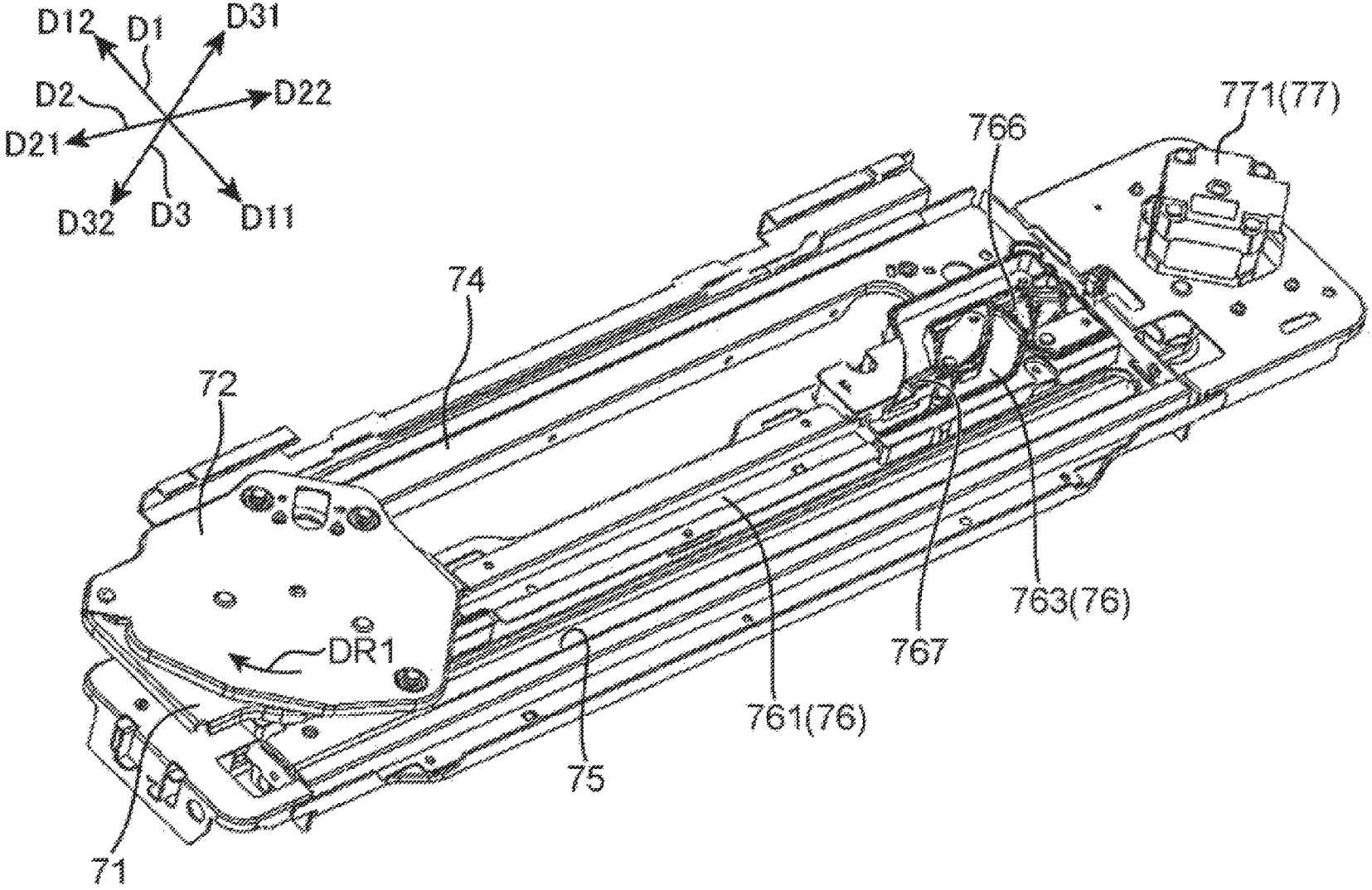
FIG. 9 is a perspective view illustrating the postures of the first movable body and the second movable body on the base member when the staple unit is in the first sway posture.
Figure 10:
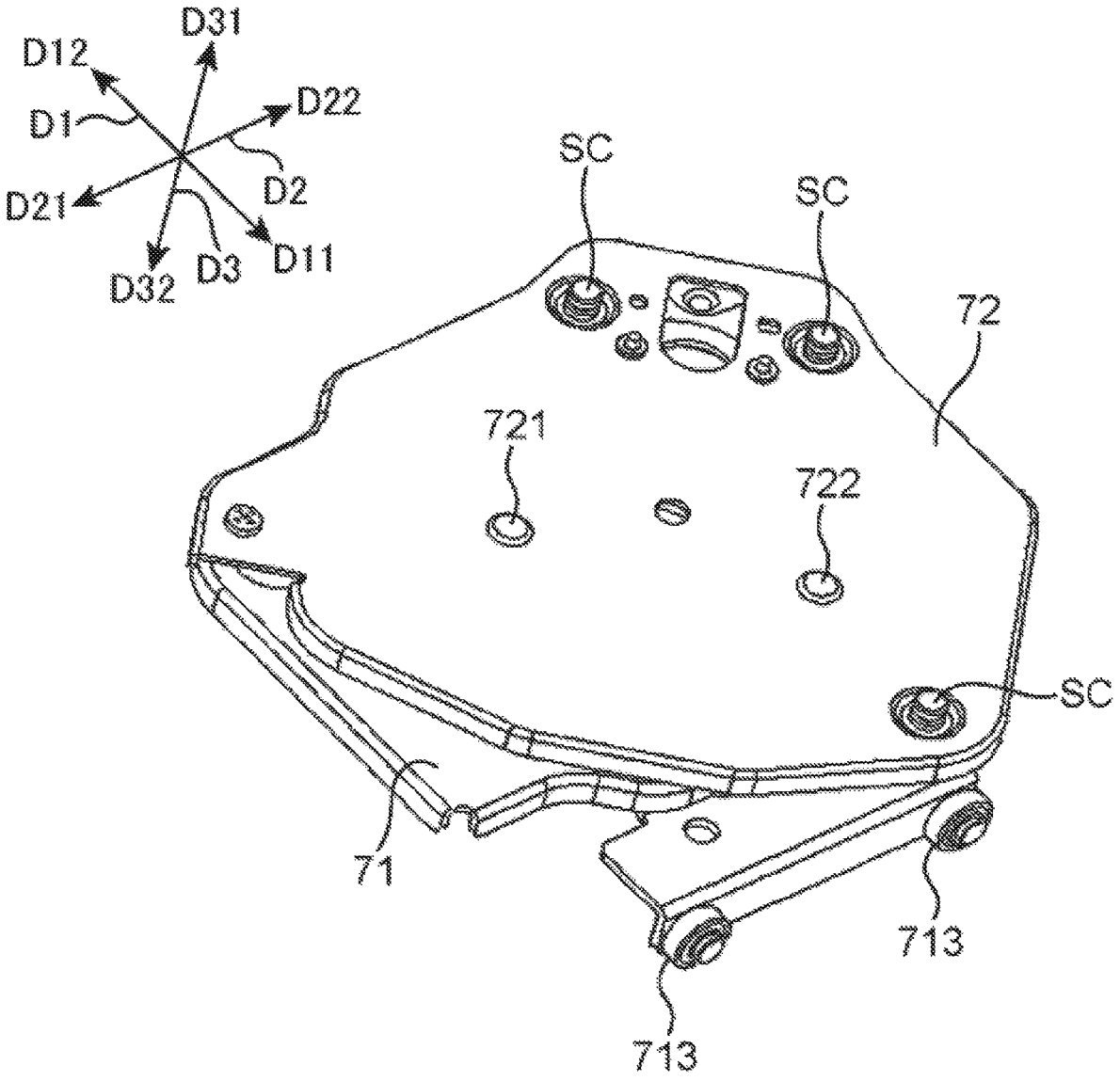
FIG. 10 is a perspective view of the first movable body and the second movable body illustrated in FIG. 9 as viewed from above.
Figure 11:
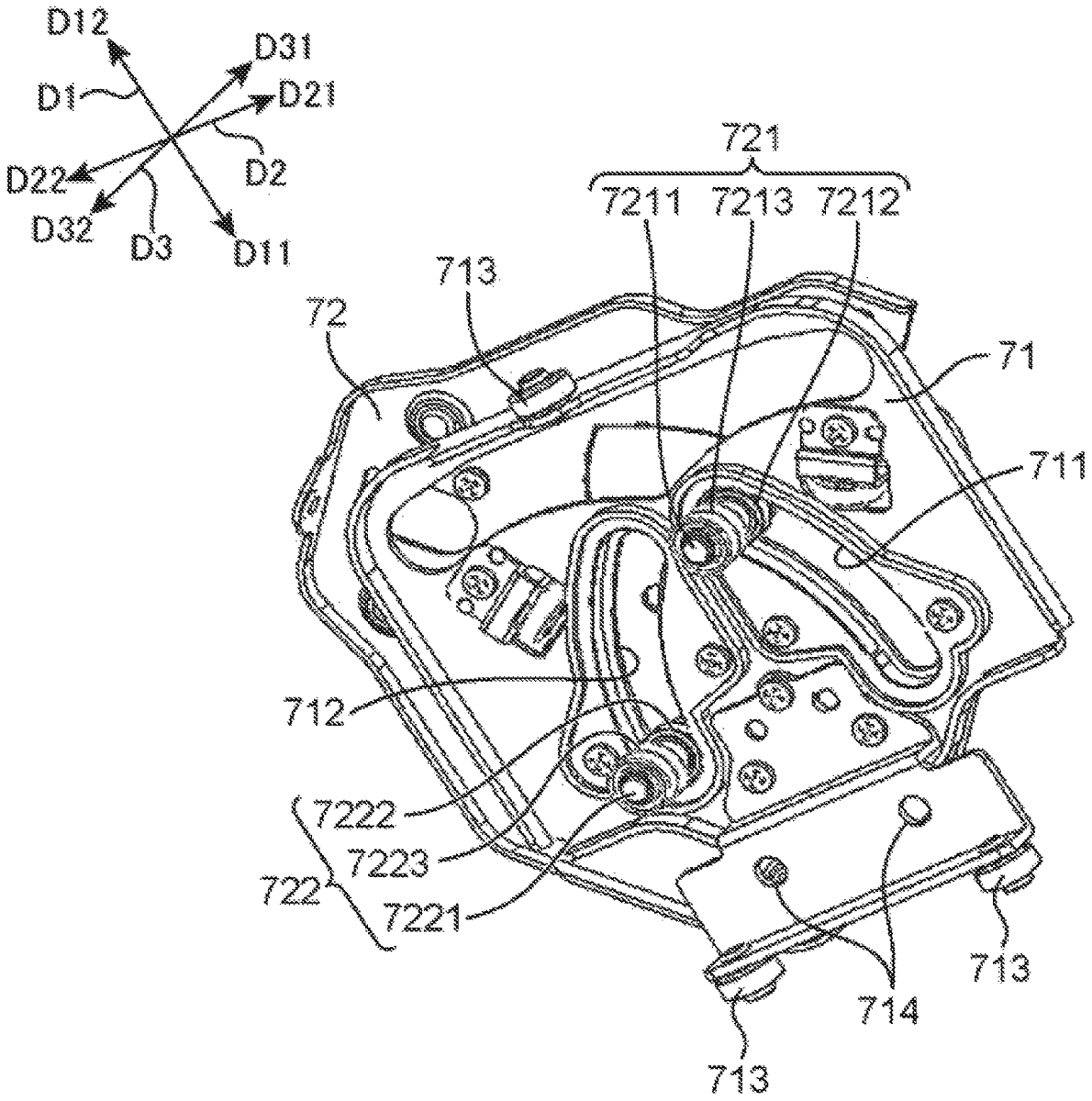
FIG. 11 is a perspective view of the first movable body and the second movable body illustrated in FIG. 9 as viewed from below.
Figure 12:
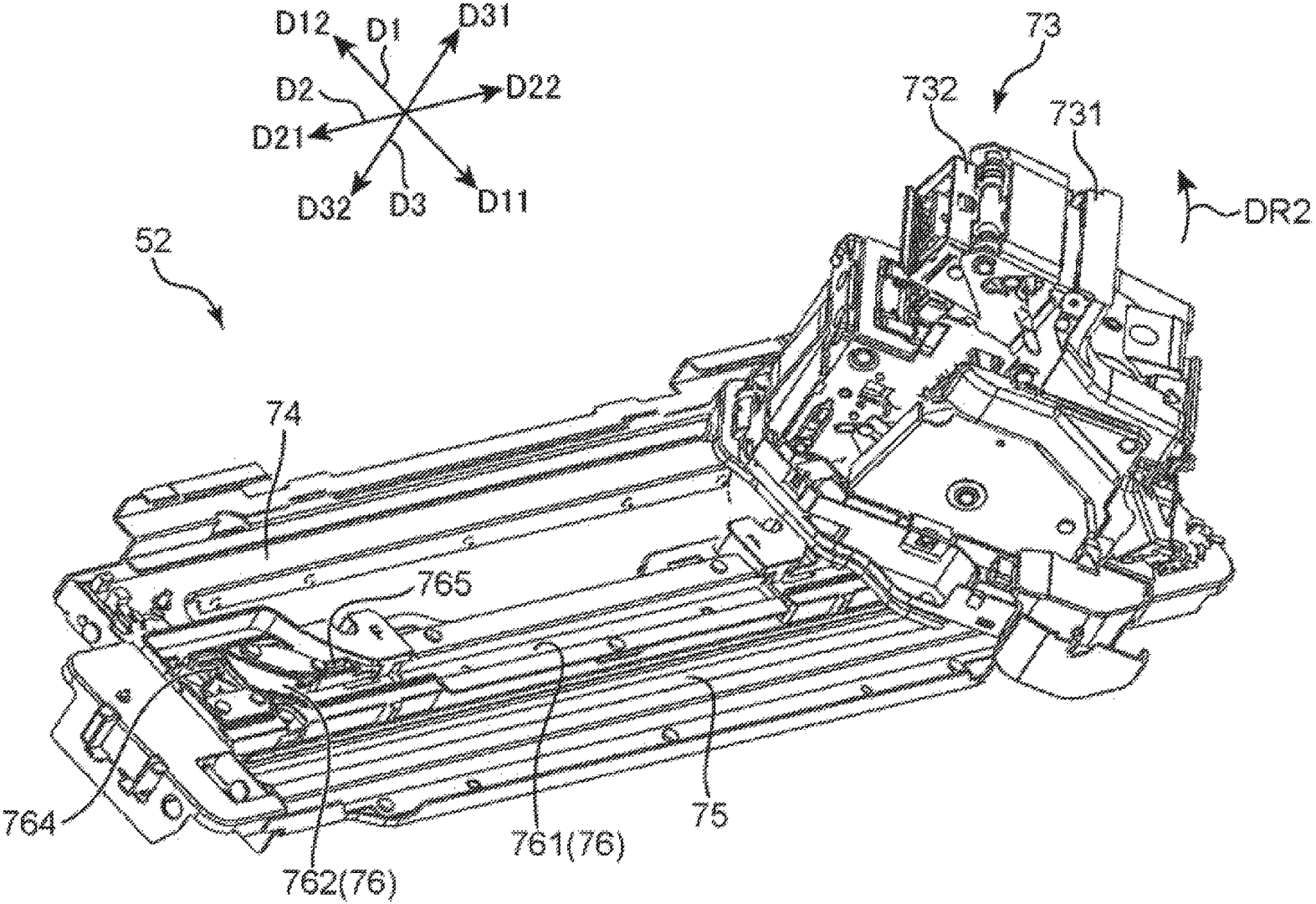
FIG. 12 is a perspective view illustrating a state where the staple unit is in a second sway posture.
Figure 13:
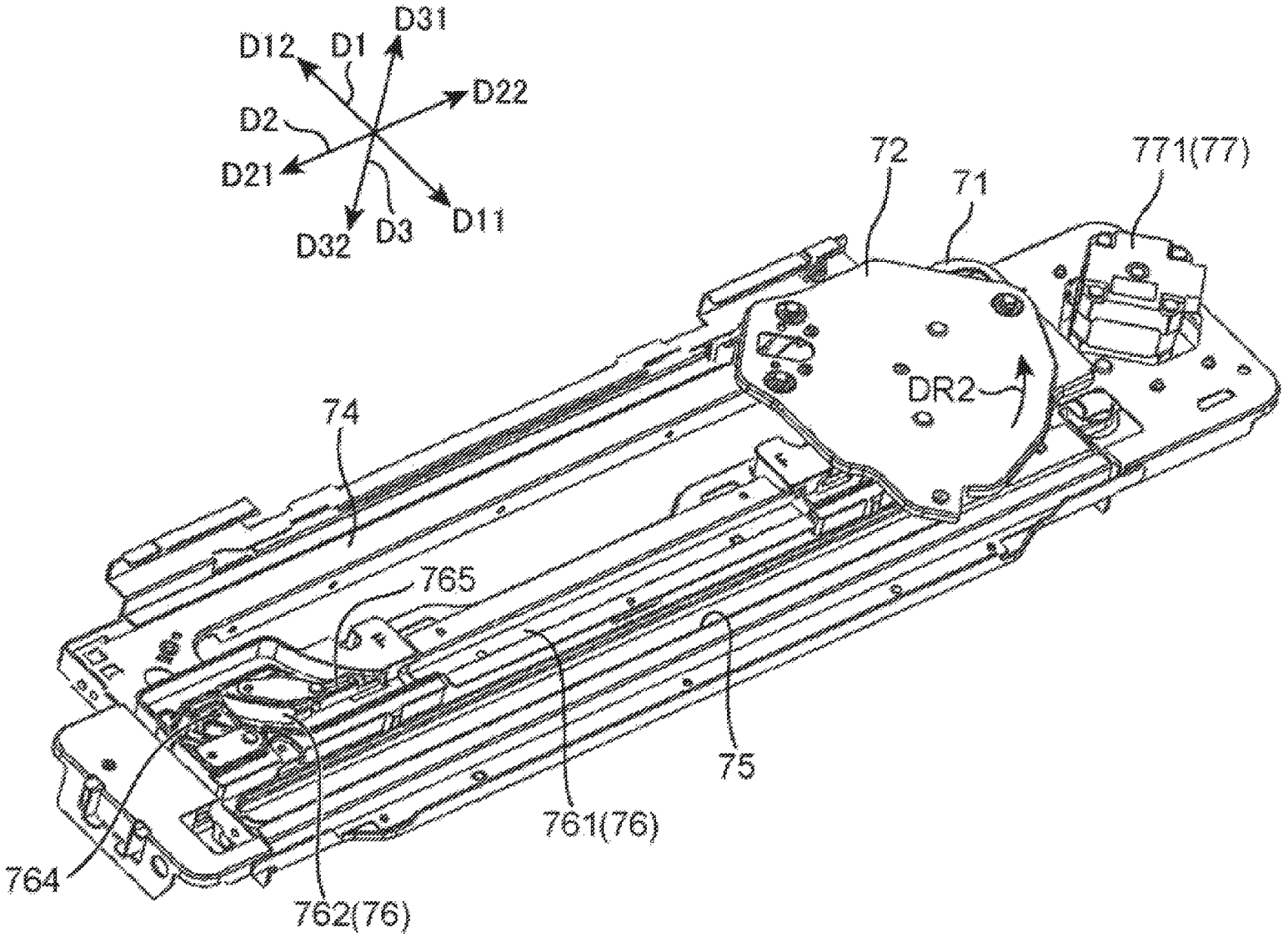
FIG. 13 is a perspective view illustrating the postures of the first movable body and the second movable body on the base member when the staple unit is in the second sway posture.
Figure 14:
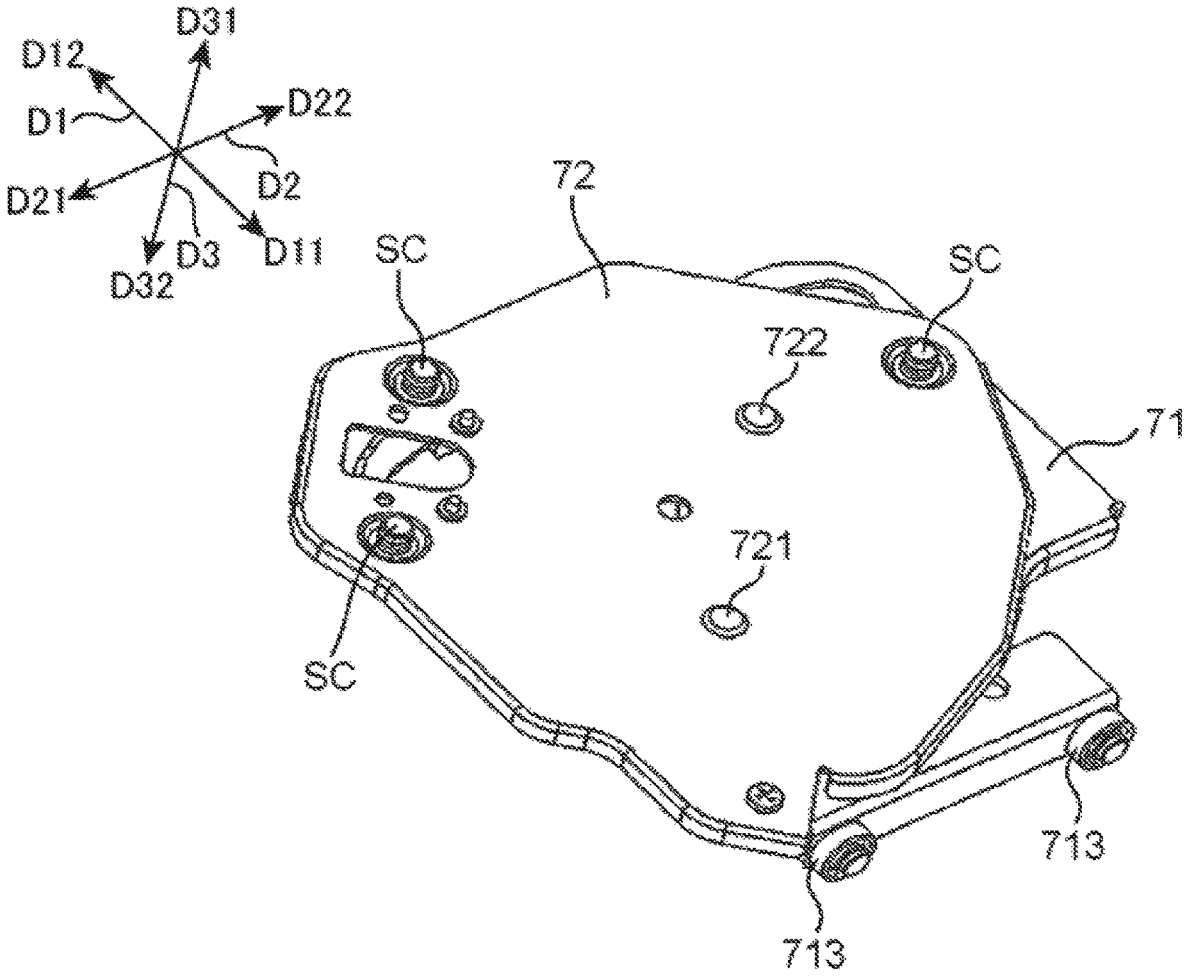
FIG. 14 is a perspective view of the first movable body and the second movable body illustrated in FIG. 13 as viewed from above.
Figure 15:
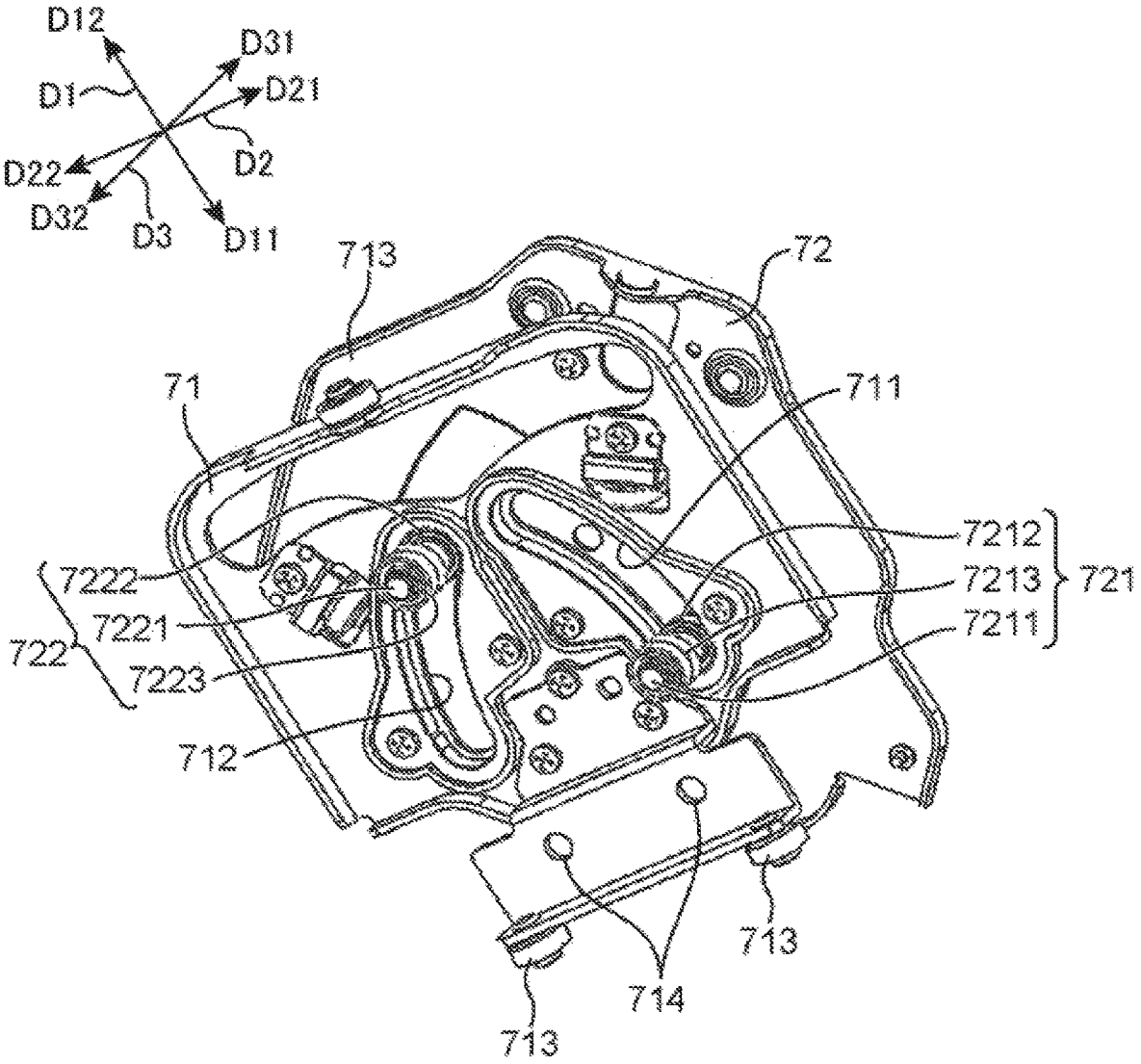
FIG. 15 is a perspective view of the first movable body and the second movable body illustrated in FIG. 13 as viewed from below.

The stapling processing apparatus 52 according to the present embodiment is described below in detail with reference to FIGS. 2 to 19 in addition to FIG. 1. FIG. 2 is a perspective view illustrating a state where a staple unit 73 of the stapling processing apparatus 52 is in a parallel posture. FIG. 3 is a perspective view illustrating the postures of a first movable body 71 and a second movable body 72 on a base member 74 when the staple unit 73 is in a parallel posture. FIG. 4 is a perspective view of the first movable body 71 and the second movable body 72 illustrated in FIG. 3 as viewed from above. FIG. 5 is a perspective view of the first movable body 71 and the second movable body 72 illustrated in FIG. 3 as viewed from below. FIG. 6 is a plan view of the base member 74 viewed from above, and FIG. 7 is a plan view of the base member 74 viewed from below. FIG. 8 is a perspective view illustrating a state where the staple unit 73 is in a first sway posture. FIG. 9 is a perspective view illustrating the postures of the first movable body 71 and the second movable body 72 on the base member 74 when the staple unit 73 is in the first sway posture. FIG. 10 is a perspective view of the first movable body 71 and the second movable body 72 illustrated in FIG. 9 as viewed from above. FIG. 11 is a perspective view of the first movable body 71 and the second movable body 72 illustrated in FIG. 9 as viewed from below. FIG. 12 is a perspective view illustrating a state where the staple unit 73 is in a second sway posture. FIG. 13 is a perspective view illustrating the postures of the first movable body 71 and the second movable body 72 on the base member 74 when the staple unit 73 is in the second sway posture. FIG. 14 is a perspective view of the first movable body 71 and the second movable body 72 illustrated in FIG. 13 as viewed from above. FIG. 15 is a perspective view of the first movable body 71 and the second movable body 72 illustrated in FIG. 13 as viewed from below. FIGS. 16 to 19 are diagrams illustrating the movement of the first movable body 71 and the second movable body 72 corresponding to one end in the width direction of a bundle of sheets S.

In the following description, the direction in which a sheet is conveyed to the staple tray 521 or the direction in which a sheet is conveyed from the staple tray 521 is referred to as "conveying direction D1". One side along the conveying direction D1, which is the downstream side for conveying a sheet, is referred to as "conveying-direction first side D11", and the other side along the conveying direction D1, which is the upstream side for conveying a sheet, is referred to as "conveying-direction second side D12". As illustrated in FIG. 1, the conveying direction D1 is a direction that is inclined with respect to the horizontal direction so that the conveying-direction first side D11 is located below the conveying-direction second side D12. The direction perpendicular to the conveying direction D1 and extending along an end edge of the bundle of sheets S stacked on the staple tray 521 is referred to as "width direction D2". One side along the width direction D2 is referred to as "width-direction first side D21", and the other side along the width direction D2 is referred to as "width-direction second side D22". The direction perpendicular to both the conveying direction D1 and the width direction D2 is referred to as "vertical direction D3". One side along the vertical direction D3 is referred to as "upper side D31", and the other side along the vertical direction D3 is referred to as "lower side D32".

The stapling processing apparatus 52 includes the staple tray 521 (FIG. 1), the first movable body 71, the second movable body 72, the staple unit 73, the base member 74, and a drive unit 77.

The staple tray 521 is a rectangular tray that extends along the plane including the conveying direction D1 and the width direction D2 and that functions as a stack unit on which the stapled bundle of sheets S is stacked. The staple tray 521 aligns the stacked sheets to form the bundle of sheets S. The staple tray 521 allows for stacking of the bundle of sheets S including multiple types of sheets with different sheet widths.

The staple unit 73 is provided to be opposed to the end edge of the bundle of sheets S stacked on the staple tray 521 on the conveying-direction first side D11. The staple unit 73 performs stapling processing to staple the bundle of sheets S with a staple SP. As illustrated in FIG. 2, and the like, the staple unit 73 is secured to the second movable body 72, which is provided so as to sway on the first movable body 71 moving linearly in the width direction D2, with a screw member SC (see FIG. 4, and the like). Accordingly, the staple unit 73 is moved in the width direction D2 along the end edge of the bundle of sheets S in accordance with the linear movement of the first movable body 71 and is changed in posture due to a posture change corresponding to the sway of the second movable body 72. Thus, the staple unit 73 may perform stapling processing for tilted stapling to insert the staple SP at a tilt with respect to the width direction D2 at a corner of the bundle of sheets S or may perform stapling processing for parallel stapling to insert the staple SP parallel to the width direction D2.

The staple unit 73 includes a staple main body 731 and a staple movable unit 732. The staple main body 731 is a main body portion of the staple unit 73 to accommodate the staples SP inside. The staple movable unit 732 is movable in the vertical direction D3 to insert the staple SP into the bundle of sheets S. As illustrated in FIG. 2, a sheet insertion area 733 is formed between the staple main body 731 and the staple movable unit 732 to insert the end edge of the bundle of sheets S.

The base member 74 is a plate-like member extending along the plane including the conveying direction D1 and the width direction D2 and arranged adjacent to the staple tray 521 on the conveying-direction first side D11 and on the lower side D32 of the staple unit 73. As illustrated in FIG. 6, the base member 74 includes a movement guide groove 75 and a posture control unit 76. The movement guide groove 75 is an elongated opening formed in an end area of the base member 74 on the conveying-direction first side D11 and extending linearly along the width direction D2. The length of the movement guide groove 75 along the width direction D2 is set to a value longer than the sheet width of the bundle of sheets S stacked on the staple tray 521. A support pin 776 projecting from a slider 775 of the drive unit 77 described below is inserted into the movement guide groove 75. The posture control unit 76 is formed on the upper surface of the base member 74 on the conveying-direction second side D12 with respect to the movement guide groove 75 to control the posture of the second movable body 72 in accordance with the linear movement of the first movable body 71. The posture control unit 76 is described in detail below.

The drive unit 77 is provided on the base member 74. As illustrated in FIGS. 6 and 7, the drive unit 77 includes a drive motor 771, a first pulley 772, a second pulley 773, a drive belt 774, and the slider 775 having the support pin 776 projected therefrom.

The drive motor 771 is a drive source that is provided in an end area of the base member 74 on the width-direction second side D22 to rotationally drive the first pulley 772. The first pulley 772 and the second pulley 773 are rotatably provided on the lower surface side of the base member 74. On the lower surface of the base member 74, the first pulley 772 is provided in an end area on the width-direction second side D22, and the second pulley 773 is provided in an end area on the width-direction first side D21. The endless drive belt 774 extends between the first pulley 772 and the second pulley 773. The first pulley 772 functions as a drive pulley that is rotationally driven by the drive motor 771. The second pulley 773 functions as a follower pulley that follows to rotate in accordance with the rotational drive of the first pulley 772 via the drive belt 774.

A linear portion of the drive belt 774 extends along the width direction D2 in a state where the drive belt 774 extends between the first pulley 772 and the second pulley 773. The slider 775 is attached to the linear portion of the drive belt 774. When the drive motor 771 is rotationally driven, the first pulley 772 rotates and accordingly the drive belt 774 is moved. As the slider 775 is attached to the drive belt 774, the slider 775 moves linearly along the width direction D2 in accordance with the movement of the drive belt 774. The slider 775 moves linearly along the width direction D2 due to the transmission of the driving force of the drive motor 771 via the first pulley 772, the second pulley 773, and the drive belt 774. The support pin 776 is projected from the slider 775 so as to extend in the vertical direction D3. As illustrated in FIG. 6, the support pin 776 is inserted into the movement guide groove 75 of the base member 74. A bearing roller 7761 is attached to the support pin 776. The bearing roller 7761 rotates in contact with the inner peripheral edge of the movement guide groove 75 when the slider 775 moves linearly with the support pin 776 inserted into the movement guide groove 75. Therefore, the slider 775 moves linearly and smoothly along the width direction D2. Although the number of the support pins 776 is not particularly limited, the two support pins 776 are projected from the slider 775 in the example illustrated in FIG. 6. The two support pins 776 are projected from the slider 775, arranged side by side in the width direction D2, and inserted into the movement guide groove 75.

The end portion of the support pin 776 on the side opposite to the side connected to the slider 775 is connected to the first movable body 71. Specifically, the first movable body 71 is connected to the slider 775 with the support pin 776 and, in this state, located on the upper side D31 of the base member 74. The first movable body 71 moves linearly along the width direction D2 in accordance with the movement of the slider 775 in response to the rotational drive of the drive motor 771. The movement range of the first movable body 71 in the width direction D2 is the same as the movement range of the slider 775 and is set in the range between the end edge of the movement guide groove 75, into which the support pin 776 is inserted and with which the bearing roller 7761 is in contact, on the width-direction first side D21 and the end edge thereof on the width-direction second side D22.

The first movable body 71 is a flat-plate shaped member extending along the plane including the conveying direction D1 and the width direction D2 and, as illustrated in FIG. 5 and the like, including a first insertion hole 711, a second insertion hole 712, a plurality of bearing rollers 713, and a support-pin coupling portion 714.

The support-pin coupling portion 714 is provided at an end of the first movable body 71 on the conveying-direction first side D11. The support-pin coupling portion 714 is a portion to which the support pin 776 is connected. The bearing rollers 713 are rotatably attached to the peripheral edge of the first movable body 71. The bearing rollers 713 rotate in contact with the upper surface of the base member 74. This allows the first movable body 71 to move linearly and smoothly on the upper surface of the base member 74 along the width direction D2.

The first insertion hole 711 and the second insertion hole 712 are holes formed so as to penetrate the first movable body 71 on the conveying-direction second side D12 with respect to the support-pin coupling portion 714 and formed with a specific interval in the width direction D2. In the first movable body 71, the first insertion hole 711 is provided on the width-direction first side D21, and the second insertion hole 712 is provided on the width-direction second side D22. A first engagement member 721 of the second movable body 72 described below is inserted into the first insertion hole 711, and a second engagement member 722 of the second movable body 72 is inserted into the second insertion hole 712. The first insertion hole 711 and the second insertion hole 712 are formed in an arc shape extending so as to intersect with the width direction D2, which is described in detail below. Specifically, the first insertion hole 711 is formed in an arc shape that extends and curves toward the width-direction second side D22 as the first insertion hole 711 comes close to the conveying-direction second side D12 so as to approach the staple tray 521. The second insertion hole 712 has an axisymmetric shape with a straight line along the conveying direction D1 as the axis of symmetry with respect to the first insertion hole 711 and is formed in an arc shape that extends and curves toward the width-direction first side D21 as the second insertion hole 712 comes close to the conveying-direction second side D12 so as to approach the staple tray 521. The detailed shapes of the first insertion hole 711 and the second insertion hole 712 are described below.

As illustrated in FIGS. 4 and 5, and the like, the second movable body 72 is provided on the first movable body 71. The second movable body 72 is provided so as to sway on the first movable body 71. Specifically, the second movable body 72 may sway with respect to the first movable body 71 while moving in the width direction D2 in accordance with the linear movement of the first movable body 71. The second movable body 72 is a flat-plate shaped member extending along the plane including the conveying direction D1 and the width direction D2 and having the staple unit 73 secured to the upper surface (mounting surface) of the second movable body 72 with the screw member SC, or the like. The second movable body 72 includes the first engagement member 721 inserted into the first insertion hole 711 and the second engagement member 722 inserted into the second insertion hole 712. The first engagement member 721 and the second engagement member 722 project from the lower surface (back surface) side on the opposite side of the mounting surface of the second movable body 72. In the second movable body 72, the first engagement member 721 is provided on the width-direction first side D21, and the second engagement member 722 is provided on the width-direction second side D22.

The first engagement member 721 is inserted into the first insertion hole 711 and is engaged with a parallel groove 761 and a first sway groove 762 in the posture control unit 76 described below. The first engagement member 721 includes a first engagement pin 7211, a first bearing roller 7212, and a second bearing roller 7213. The first engagement pin 7211 is a pin member that projects vertically from the lower surface of the second movable body 72 toward the first movable body 71. The first bearing roller 7212 is a bearing roller that is rotatably attached to the upper end of the first engagement pin 7211. The first bearing roller 7212 rotates in contact with the inner peripheral edge of the first insertion hole 711 in a state where the first engagement member 721 is inserted into the first insertion hole 711. Therefore, although the details are described below, the first engagement member 721 moves smoothly along the first insertion hole 711 in accordance with the linear movement of the first movable body 71. The second bearing roller 7213 is a bearing roller that is rotatably attached to the lower end of the first engagement pin 7211. The second bearing roller 7213 rotates in contact with the inner peripheral edges of the parallel groove 761 and the first sway groove 762 in the posture control unit 76 in a state where the first engagement member 721 is inserted into the first insertion hole 711. Therefore, although the details are described below, the first engagement member 721 moves smoothly along the parallel groove 761 and the first sway groove 762 in accordance with the linear movement of the first movable body 71.

The second engagement member 722 is inserted into the second insertion hole 712 and is engaged with the parallel groove 761 and a second sway groove 763 in the posture control unit 76 described below. The second engagement member 722 includes a second engagement pin 7221, a third bearing roller 7222, and a fourth bearing roller 7223. The second engagement pin 7221 is a pin member that protrudes vertically from the lower surface of the second movable body 72 toward the first movable body 71 on the width-direction second side D22 with respect to the first engagement pin 7211. The third bearing roller 7222 is a bearing roller that is rotatably attached to the upper end of the second engagement pin 7221. The third bearing roller 7222 rotates in contact with the inner peripheral edge of the second insertion hole 712 in a state where the second engagement member 722 is inserted into the second insertion hole 712. Therefore, although the details are described below, the second engagement member 722 moves smoothly along the second insertion hole 712 in accordance with the linear movement of the first movable body 71. The fourth bearing roller 7223 is a bearing roller that is rotatably attached to the lower end of the second engagement pin 7221. The fourth bearing roller 7223 rotates in contact with the inner peripheral edges of the parallel groove 761 and the second sway groove 763 in the posture control unit 76 in a state where the second engagement member 722 is inserted into the second insertion hole 712. Therefore, although the details are described below, the second engagement member 722 moves smoothly along the parallel groove 761 and the second sway groove 763 in accordance with the linear movement of the first movable body 71.

As described above, the posture control unit 76 is provided on the upper surface of the base member 74. As illustrated in FIG. 6, the posture control unit 76 is provided on the base member 74 on the conveying-direction second side D12 with respect to the movement guide groove 75. In engagement with the first engagement member 721 and the second engagement member 722, the posture control unit 76 guides the movement of the first engagement member 721 and the second engagement member 722 in accordance with the linear movement of the first movable body 71 to sway the second movable body 72 so as to control the posture of the second movable body 72. The posture control unit 76 includes the parallel groove 761, the first sway groove 762, and the second sway groove 763.

The parallel groove 761 is a groove portion extending linearly along the width direction D2. The length of the parallel groove 761 along the width direction D2 is shorter than the length of the movement guide groove 75 along the width direction D2 and is set to be substantially the same length as the sheet width of the bundle of sheets S stacked on the staple tray 521. The parallel groove 761 is engaged with the first engagement member 721 inserted into the first insertion hole 711 and is engaged with the second engagement member 722 inserted into the second insertion hole 712 (see FIG. 16). Specifically, the parallel groove 761 is engaged with the first engagement member 721 in contact with the second bearing roller 7213 and is engaged with the second engagement member 722 in contact with the fourth bearing roller 7223.

Figure 16:
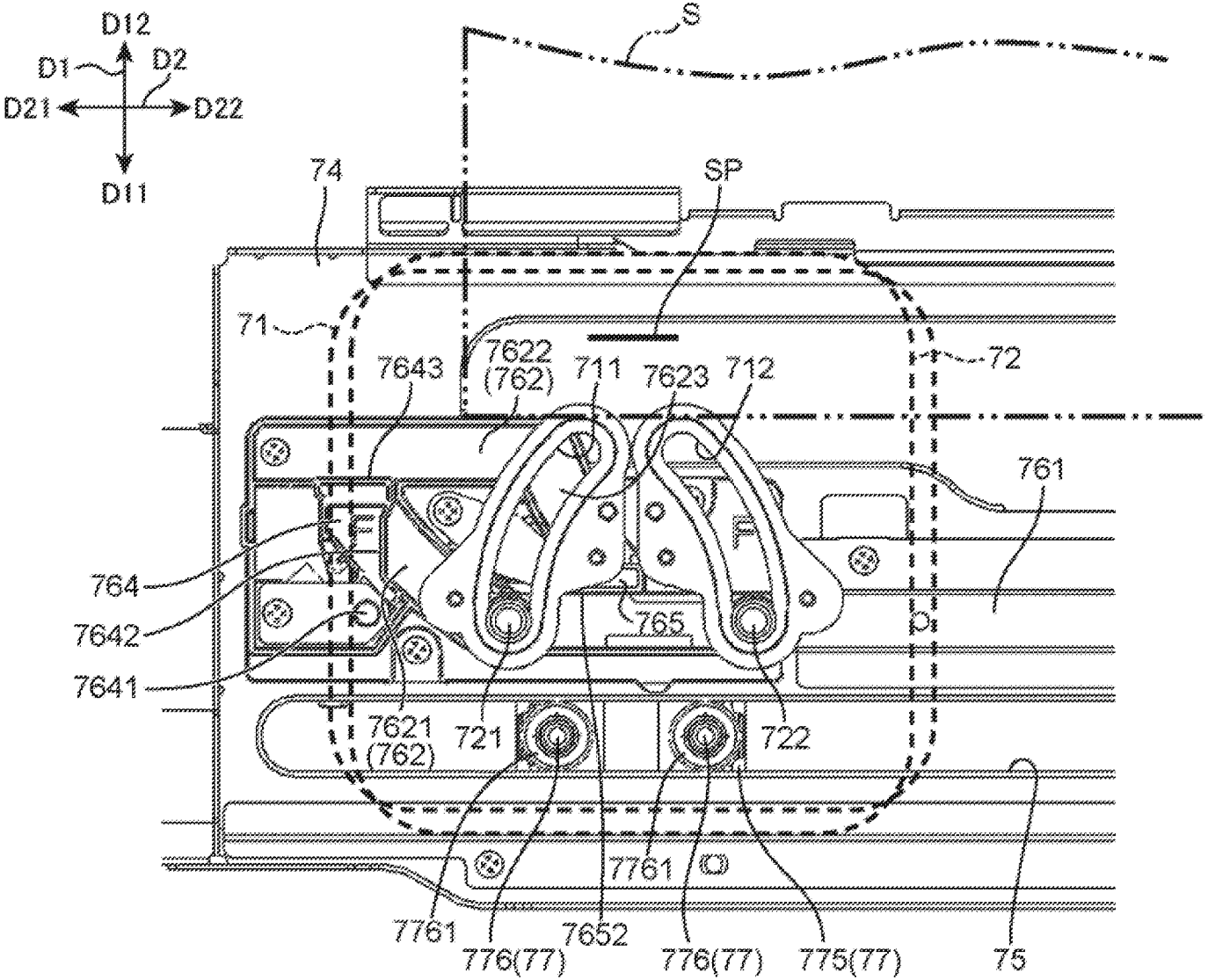
FIG. 16 is a diagram illustrating the movement of the first movable body and the second movable body corresponding to one end of a bundle of sheets with respect to the width direction.

The parallel groove 761 guides the first engagement member 721 and the second engagement member 722 to move in alignment with each other in the width direction D2 in accordance with the linear movement of the first movable body 71 so as to maintain the posture of the second movable body 72 in a parallel posture so that the staple unit 73 is in a posture parallel to the width direction D2 (see FIGS. 3 to 5 and 16). As illustrated in FIG. 16, while the two engagement members, i.e., the first engagement member 721 and the second engagement member 722, are moved in the parallel groove 761, the first engagement member 721 is located at a position in contact with the end edge of the first insertion hole 711 on the conveying-direction first side D11, and the second engagement member 722 is located at a position in contact with the end edge of the second insertion hole 712 on the conveying-direction first side D11. Further, when the two engagement members, i.e., the first engagement member 721 and the second engagement member 722, are moved in the parallel groove 761 and the posture of the second movable body 72 is maintained in a parallel posture, the posture of the staple unit 73 secured to the second movable body 72 is also maintained in the same parallel posture as that of the second movable body 72 (see FIG. 2). When the driving of the drive motor 771 is stopped and therefore the first movable body 71 is stopped at a specific stapling position while the staple unit 73 is maintained in the parallel posture, the staple unit 73 may execute stapling processing for parallel stapling to insert the staple SP into the bundle of sheets S in parallel with the width direction D2 (see FIG. 16).

The first sway groove 762 is a groove portion connected to an end (one end) of the parallel groove 761 on the width-direction first side D21. According to the present embodiment, as illustrated in FIG. 6, the first sway groove 762 includes a first end arc area 7621, a first linear area 7622, and a first intermediate arc area 7623.

In the first sway groove 762, the first end arc area 7621 is an area portion extending in an arc shape from one end of the parallel groove 761 so as to approach the staple tray 521. The first end arc area 7621 guides the second movable body 72 to a first corner stapling position so that the staple unit 73 may execute tilted stapling at a corner of the bundle of sheets S on the width-direction first side D21. Specifically, the first end arc area 7621 is formed in an arc shape curving and extending toward the conveying-direction second side D12 so as to approach the staple tray 521 as the first end arc area 7621 comes close to the width-direction first side D21 from the end of the parallel groove 761. The first linear area 7622 is an area portion extending linearly along the width direction D2 from the end of the first end arc area 7621 toward the width-direction second side D22. The first intermediate arc area 7623 is an area portion extending in an arc shape from the end of the first linear area 7622 on the width-direction second side D22 so as to move away from the staple tray 521 and connecting to an intermediate portion of the parallel groove 761. Specifically, the first intermediate arc area 7623 is formed in an arc shape curving and extending toward the conveying-direction first side D11 so as to move away from the staple tray 521 as the first intermediate arc area 7623 comes close toward the width-direction second side D22 from the end of the first linear area 7622. The intermediate portion of the parallel groove 761 to which the end of the first intermediate arc area 7623 is connected is located at a position shifted from one end of the parallel groove 761 toward the width-direction second side D22 by the length corresponding to the first linear area 7622 along the width direction D2.

Here, the shape of the first insertion hole 711 formed in the first movable body 71 into which the first engagement member 721 of the second movable body 72 is inserted is described. As described above, the first insertion hole 711 is formed in an arc shape curving and extending toward the width-direction second side D22 as the first insertion hole 711 comes close to the conveying-direction second side D12 so as to approach the staple tray 521. The shape of the first insertion hole 711 corresponds to the shapes of the first end arc area 7621 and the first intermediate arc area 7623. As illustrated in FIG. 16, the first insertion hole 711 is formed in an arc shape extending from the parallel groove 761 to the first linear area 7622.

Figure 17:
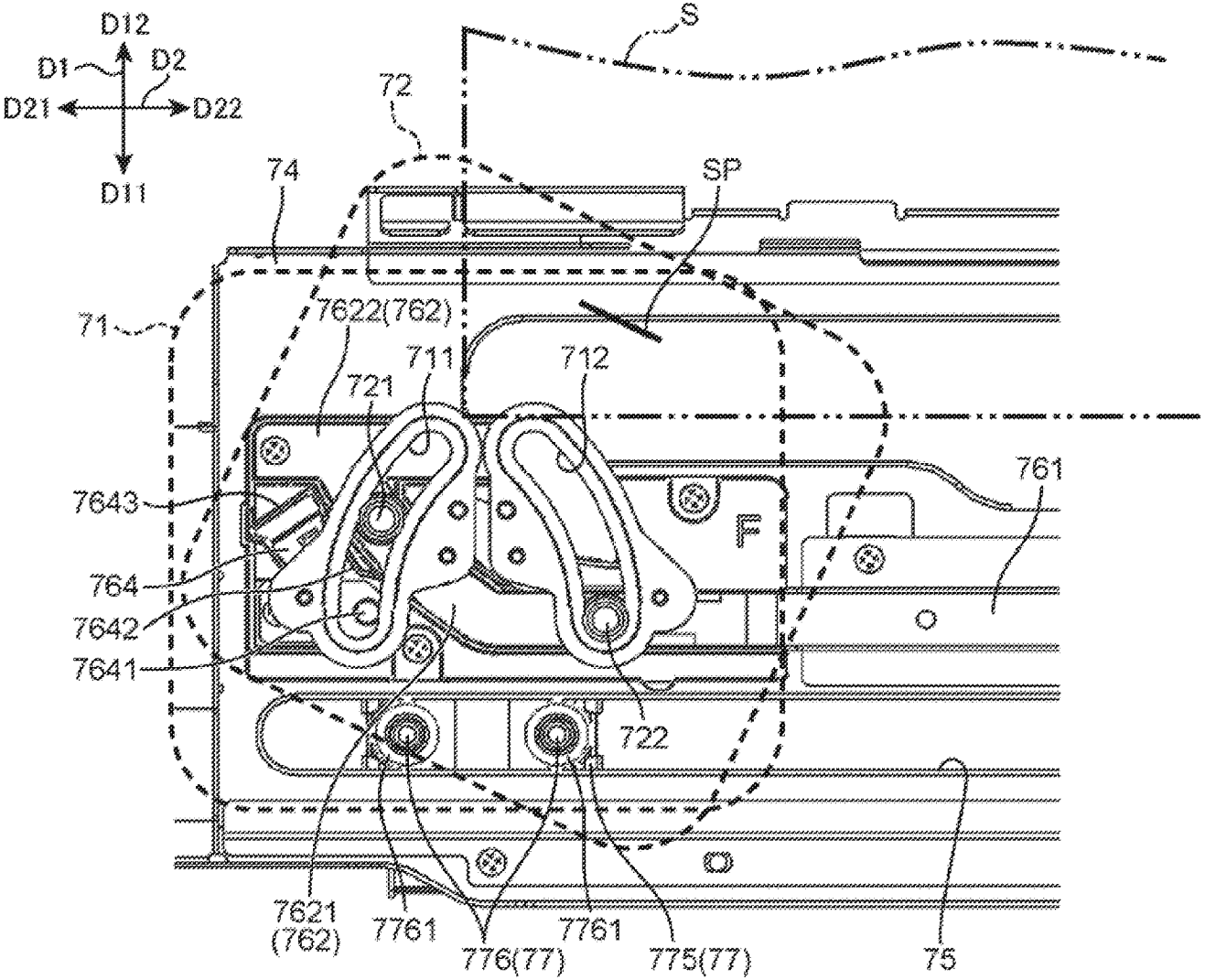
FIG. 17 is a diagram illustrating the movement of the first movable body and the second movable body corresponding to one end of a bundle of sheets with respect to the width direction.

With regard to the linear movement of the first movable body 71 based on the driving of the drive motor 771, it is assumed that the first movable body 71 is moved such that the support pin 776 is located in the movement guide groove 75 on the width-direction first side D21 with respect to the position corresponding to one end of the parallel groove 761. In this case, while the second engagement member 722 is moving in the parallel groove 761 in accordance with the linear movement of the first movable body 71 to the width-direction first side D21, the first end arc area 7621 guides the movement of the first engagement member 721 to change the posture of the second movable body 72 from the parallel posture to the first sway posture due to the sway (rotation) in a first direction DR1 around the second engagement member 722 (see FIGS. 9 to 11 and 17). As illustrated in FIG. 17, the first engagement member 721 moves in the first end arc area 7621 while moving away from the end edge of the first insertion hole 711 on the conveying-direction first side D11 and moving along the first insertion hole 711, and the second engagement member 722 moves in the parallel groove 761 while maintaining the state in contact with the end edge of the second insertion hole 712 on the conveying-direction first side D11. In this case, the first engagement member 721 is located at a position closer to the staple tray 521 with respect to the second engagement member 722, and the first engagement member 721 and the second engagement member 722 are arranged side by side in a direction intersecting with the width direction D2. Therefore, the posture of the second movable body 72 is changed from the parallel posture to the first sway posture, and accordingly the posture of the staple unit 73 is also changed from the parallel posture to the first sway posture (see FIG. 8). When the driving of the drive motor 771 is stopped so that the movement of the first movable body 71 is stopped in a state where the first engagement member 721 is located in the first end arc area 7621 and the second engagement member 722 is located in the parallel groove 761 and thus the second movable body 72 is set in the first corner stapling position, the staple unit 73 may execute stapling processing for tilted stapling to insert the staple SP at a tilt with respect to the width direction D2 at a corner of the bundle of sheets S on the width-direction first side D21 (see FIG. 17).

Figure 18:
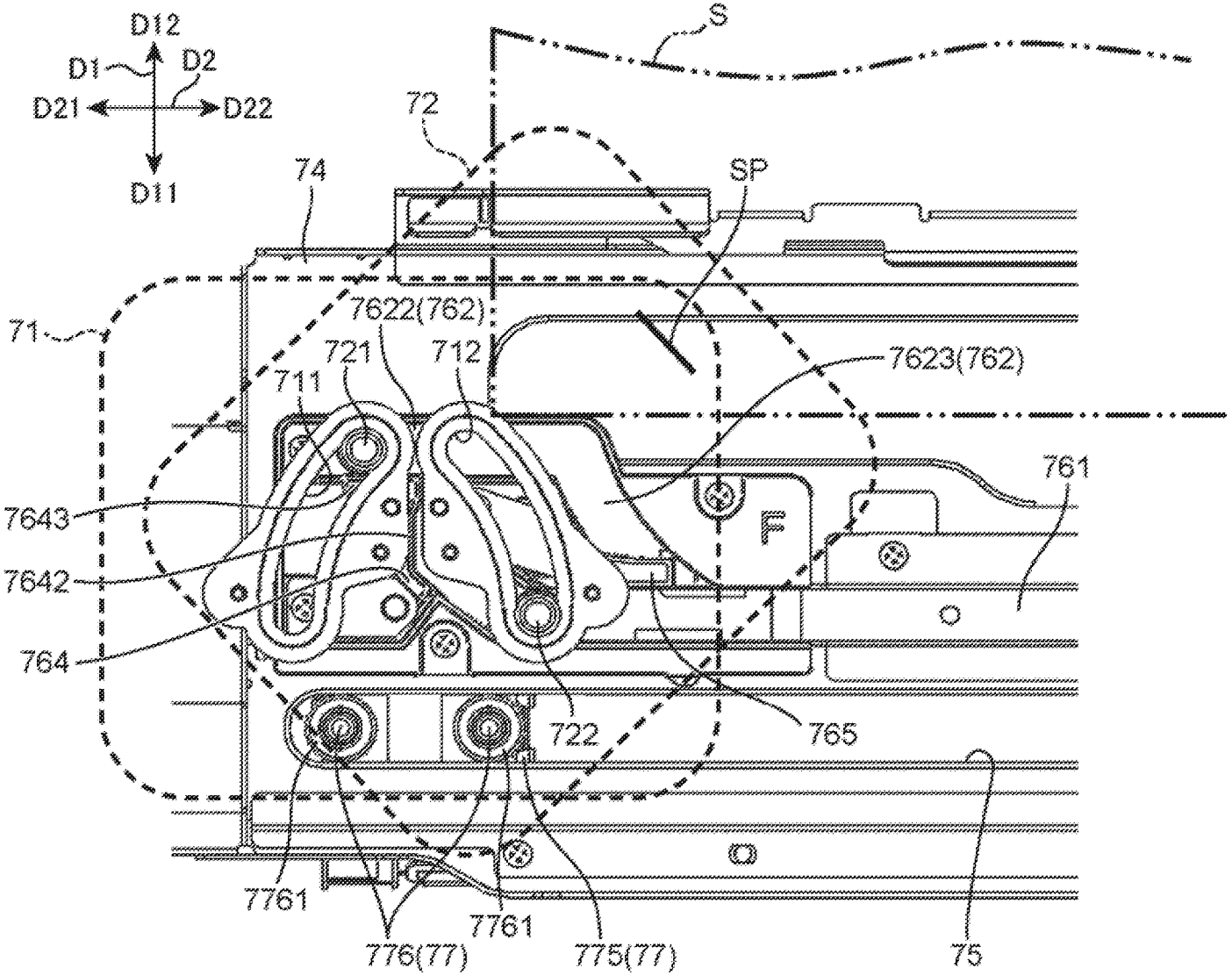
FIG. 18 is a diagram illustrating the movement of the first movable body and the second movable body corresponding to one end of a bundle of sheets with respect to the width direction.

When the first engagement member 721 reaches the first linear area 7622 after moving in the first end arc area 7621 in accordance with the linear movement of the first movable body 71 to the width-direction first side D21, the first engagement member 721 is located at a position in contact with the end edge of the first insertion hole 711 on the conveying-direction second side D12, and the second engagement member 722 is located at a position in contact with the end edge of the second insertion hole 712 on the conveying-direction first side D11 (see FIG. 18). In this state, when the driving of the drive motor 771 is stopped so that the movement of the first movable body 71 is stopped, the staple unit 73 may execute stapling processing for tilted stapling to insert the staple SP at a tilt with respect to the width direction D2 at a corner of the bundle of sheets S on the width-direction first side D21. When the stapling processing for tilted stapling illustrated in FIG. 18 is compared with the stapling processing for tilted stapling illustrated in FIG. 17 above, the tilt angles of the staples SP with respect to the width direction D2 are different. That is, for tilted-stapling stapling processing, the tilt angle of the staple SP may be adjusted in accordance with the position of the first engagement member 721 located in the first end arc area 7621.

When the first movable body 71 linearly moves to the width-direction second side D22 in a state where the first engagement member 721 has reached the first linear area 7622 after moving in the first end arc area 7621, the second engagement member 722 moves in the parallel groove 761 to the width-direction second side D22, and the first engagement member 721 moves in the first linear area 7622 to the width-direction second side D22. As the first linear area 7622 is an area extending linearly in the width direction D2, the posture of the second movable body 72 is maintained at the first sway posture when the first engagement member 721 moves in the first linear area 7622. Therefore, the posture of the staple unit 73 is maintained at the first sway posture as with the second movable body 72. Thus, the staple unit 73 may execute tilted stapling at a corner on the width-direction first side D21 in response to each of the bundles of sheets S that are multiple types of sheets having different sheet widths.

Figure 19:
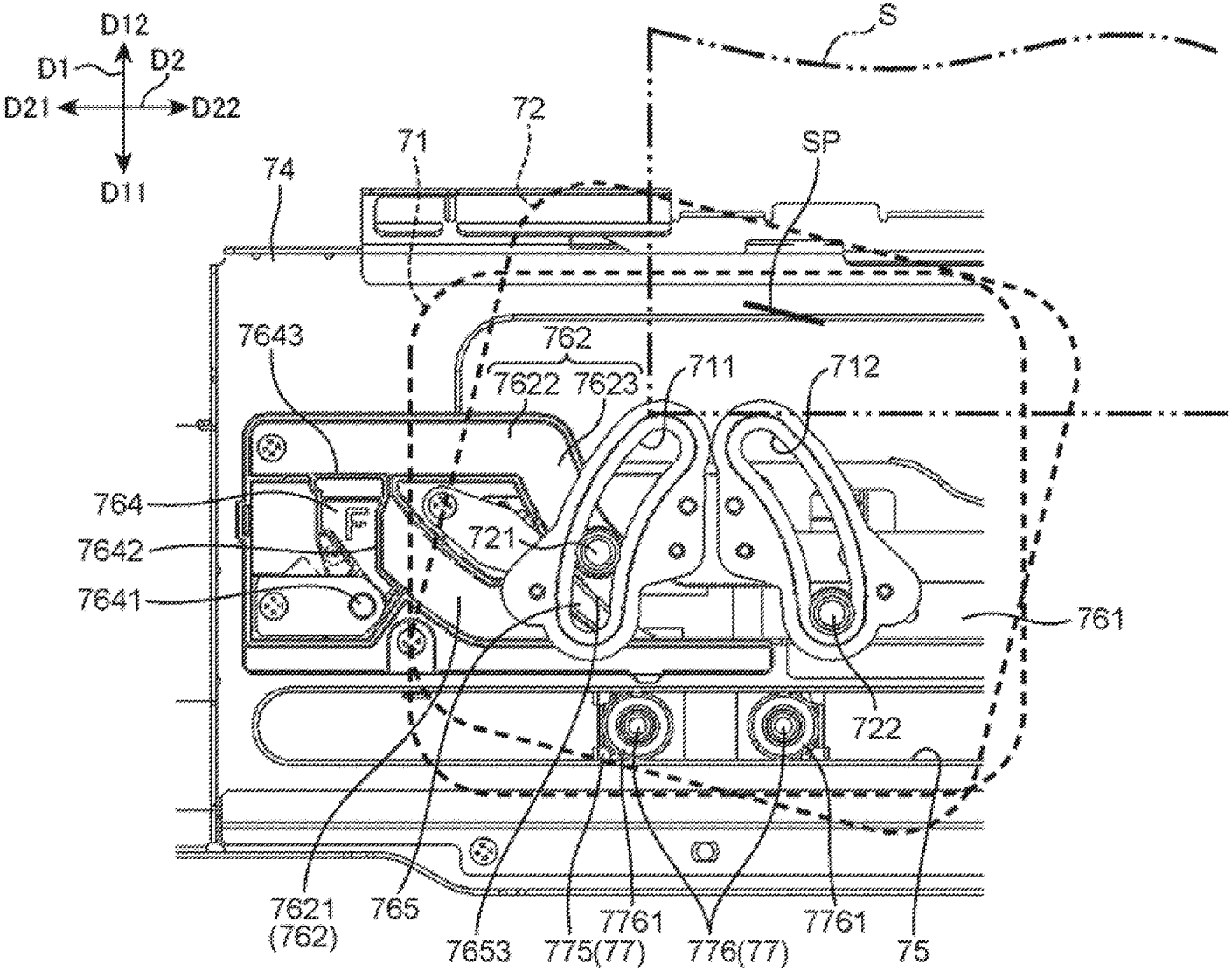
FIG. 19 is a diagram illustrating the movement of the first movable body and the second movable body corresponding to one end of a bundle of sheets with respect to the width direction.

When the first movable body 71 continuously moves straight to the width-direction second side D22 while the first engagement member 721 is moving in the first linear area 7622, the first engagement member 721 eventually moves from the first linear area 7622 to the first intermediate arc area 7623 (see FIG. 19). In this case, while the second engagement member 722 is moving in the parallel groove 761 in accordance with the linear movement of the first movable body 71 to the width-direction second side D22, the first engagement member 721 moves in the first intermediate arc area 7623 while moving away from the end edge of the first insertion hole 711 on the conveying-direction second side D12 and moving along the first insertion hole 711 so that the posture of the second movable body 72 is changed from the first sway posture to the parallel posture. Accordingly, the posture of the staple unit 73 is changed from the first sway posture to the parallel posture as with the second movable body 72.

The respective groove widths of the parallel groove 761 and the first sway groove 762 constituting the posture control unit 76 to guide the movement of the first engagement member 721 and the second engagement member 722 in accordance with the linear movement of the first movable body 71 are set to be a width that allows the contact with the second bearing roller 7213 of the first engagement member 721 and the fourth bearing roller 7223 of the second engagement member 722 over the entire lengths of the parallel groove 761 and the first sway groove 762. Accordingly, the first engagement member 721 is in constant contact with the parallel groove 761 and the first sway groove 762 while moving in the grooves, and the second engagement member 722 is in constant contact with the parallel groove 761 while moving in the parallel groove 761. This improves the stability of movement of the first engagement member 721 and the second engagement member 722 and allows smooth movement. As a result, the posture change of the second movable body 72 in accordance with the movement of the first engagement member 721 in the first sway groove 762 may be smooth, and the posture change of the staple unit 73 may be stable.

The first insertion hole 711 provided in the first movable body 71 and having the first engagement member 721 inserted therethrough is formed in an arc shape corresponding to the shapes of the first end arc area 7621 and the first intermediate arc area 7623 through which the first engagement member 721 moves. Accordingly, the first insertion hole 711 may guide the sway of the second movable body 72 in accordance with the movement of the first engagement member 721 in the first end arc area 7621 and the first intermediate arc area 7623. Therefore, smoother movement is possible when the first engagement member 721 moves between the parallel groove 761 and the first sway groove 762. Thus, the posture change of the second movable body 72 in accordance with the movement of the first engagement member 721 between the parallel groove 761 and the first sway groove 762 may be smoother, and the posture change of the staple unit 73 may be stable.

The hole size of the first insertion hole 711 is set to be a size that allows the contact with the first bearing roller 7212 of the first engagement member 721 over the entire length of the first insertion hole 711. Thus, it is possible to guide the sway of the second movable body 72 in a smoother way in accordance with the movement of the first engagement member 721 in the first sway groove 762 due to the contact between the first engagement member 721 and the first insertion hole 711.

Next, the second sway groove 763, which forms the posture control unit 76, is described primarily with reference to FIGS. 6 and 12 to 15. The second sway groove 763 is a groove portion connected to the end (the other end) of the parallel groove 761 on the width-direction second side D22. According to the present embodiment, as illustrated in FIG. 6, the second sway groove 763 includes a second end arc area 7631, a second linear area 7632, and a second intermediate arc area 7633. The shape of each area of the second sway groove 763 has a shape axisymmetric to each area of the first sway groove 762 with a straight line extending through the center of the parallel groove 761 with respect to the width direction D2 and extending along the conveying direction D1 as the axis of symmetry. Specifically, the second end arc area 7631 is axisymmetric to the first end arc area 7621, the second linear area 7632 is axisymmetric to the first linear area 7622, and the second intermediate arc area 7633 is axisymmetric to the first intermediate arc area 7623. As the second sway groove 763 is axisymmetric to the first sway groove 762, the detailed description of the shape of the second sway groove 763 is omitted.

The shape of the second insertion hole 712 formed in the first movable body 71 and having the second engagement member 722 of the second movable body 72 inserted therethrough is described. As described above, the second insertion hole 712 is formed in an arc shape curving and extending toward the width-direction first side D21 as the second insertion hole 712 comes closer to the conveying-direction second side D12 so as to approach the staple tray 521. The shape of the second insertion hole 712 corresponds to the shapes of the second end arc area 7631 and the second intermediate arc area 7633. Specifically, the second insertion hole 712 is formed in an arc shape extending from the parallel groove 761 to the second linear area 7632.

With regard to the linear movement of the first movable body 71 based on the driving of the drive motor 771, it is assumed that the first movable body 71 is moved such that the support pin 776 is located in the movement guide groove 75 on the width-direction second side D22 with respect to the position corresponding to the other end of the parallel groove 761. In this case, the second end arc area 7631 guides the second movable body 72 to a second corner stapling position so that the staple unit 73 may execute tilted stapling at a corner of the bundle of sheets S on the width-direction second side D22. While the first engagement member 721 is moving in the parallel groove 761 in accordance with the linear movement of the first movable body 71 to the width-direction second side D22, the second end arc area 7631 guides the movement of the second engagement member 722 to change the posture of the second movable body 72 from the parallel posture to the second sway posture due to the sway (rotation) in a second direction DR2 around the first engagement member 721 (see FIGS. 13 to 15). The second engagement member 722 moves in the second end arc area 7631 while moving away from the end edge of the second insertion hole 712 on the conveying-direction first side D11 and moving along the second insertion hole 712, and the first engagement member 721 moves in the parallel groove 761 while maintaining the state in contact with the end edge of the first insertion hole 711 on the conveying-direction first side D11. In this case, the second engagement member 722 is located at a position closer to the staple tray 521 with respect to the first engagement member 721, and the first engagement member 721 and the second engagement member 722 are arranged side by side in a direction intersecting with the width direction D2. Therefore, the posture of the second movable body 72 is changed from the parallel posture to the second sway posture, and accordingly the posture of the staple unit 73 is also changed from the parallel posture to the second sway posture (see FIG. 12). When the driving of the drive motor 771 is stopped so that the movement of the first movable body 71 is stopped in a state where the second engagement member 722 is located in the second end arc area 7631 and the first engagement member 721 is located in the parallel groove 761 and thus the second movable body 72 is set in the second corner stapling position, the staple unit 73 may execute stapling processing for tilted stapling to insert the staple SP at a tilt with respect to the width direction D2 at a corner of the bundle of sheets S on the width-direction second side D22.

When the second engagement member 722 reaches the second linear area 7632 after moving in the second end arc area 7631 in accordance with the linear movement of the first movable body 71 to the width-direction second side D22, the second engagement member 722 is located at a position in contact with the end edge of the second insertion hole 712 on the conveying-direction second side D12, and the first engagement member 721 is located at a position in contact with the end edge of the first insertion hole 711 on the conveying-direction first side D11 (see FIG. 15). In this state, when the driving of the drive motor 771 is stopped so that the movement of the first movable body 71 is stopped, the staple unit 73 may execute stapling processing for tilted stapling to insert the staple SP at a tilt with respect to the width direction D2 at a corner of the bundle of sheets S on the width-direction second side D22.

When the first movable body 71 linearly moves to the width-direction first side D21 in a state where the second engagement member 722 has reached the second linear area 7632 after moving in the second end arc area 7631, the first engagement member 721 moves in the parallel groove 761 to the width-direction first side D21, and the second engagement member 722 moves in the second linear area 7632 to the width-direction first side D21. As the second linear area 7632 is an area extending linearly in the width direction D2, the posture of the second movable body 72 is maintained at the second sway posture when the second engagement member 722 moves in the second linear area 7632. Therefore, the posture of the staple unit 73 is maintained at the second sway posture as with the second movable body 72. Thus, the staple unit 73 may execute tilted stapling at a corner on the width-direction second side D22 in response to each of the bundles of sheets S that are multiple types of sheets having different sheet widths.

When the first movable body 71 continuously moves straight to the width-direction first side D21 while the second engagement member 722 is moving in the second linear area 7632, the second engagement member 722 eventually moves from the second linear area 7632 to the second intermediate arc area 7633. In this case, while the first engagement member 721 is moving in the parallel groove 761 in accordance with the linear movement of the first movable body 71 to the width-direction first side D21, the second engagement member 722 moves in the second intermediate arc area 7633 while moving away from the end edge of the second insertion hole 712 on the conveying-direction second side D12 and moving along the second insertion hole 712 so that the posture of the second movable body 72 is changed from the second sway posture to the parallel posture. Accordingly, the posture of the staple unit 73 is changed from the second sway posture to the parallel posture as with the second movable body 72.

The groove width of the second sway groove 763 is set to a width that allows the contact with the fourth bearing roller 7223 of the second engagement member 722 over the entire length of the second sway groove 763. Accordingly, the second engagement member 722 is in constant contact with the second sway groove 763 while moving in the second sway groove 763. This improves the stability of movement of the second engagement member 722 and allows smooth movement. As a result, the posture change of the second movable body 72 in accordance with the movement of the second engagement member 722 in the second sway groove 763 may be smooth, and the posture change of the staple unit 73 may be stable.

The second insertion hole 712 provided in the first movable body 71 and having the second engagement member 722 inserted therethrough is formed in an arc shape corresponding to the shapes of the second end arc area 7631 and the second intermediate arc area 7633 through which the second engagement member 722 moves. Accordingly, the second insertion hole 712 may guide the sway of the second movable body 72 in accordance with the movement of the second engagement member 722 in the second end arc area 7631 and the second intermediate arc area 7633. Therefore, smoother movement is possible when the second engagement member 722 moves between the parallel groove 761 and the second sway groove 763. Thus, the posture change of the second movable body 72 in accordance with the movement of the second engagement member 722 between the parallel groove 761 and the second sway groove 763 may be smoother, and the posture change of the staple unit 73 may be stable.

The hole size of the second insertion hole 712 is set to be a size that allows the contact with the third bearing roller 7222 of the second engagement member 722 over the entire length of the second insertion hole 712. Thus, it is possible to guide the sway of the second movable body 72 in a smoother way in accordance with the movement of the second engagement member 722 in the second sway groove 763 due to the contact between the second engagement member 722 and the second insertion hole 712.

As described above, during the posture change of the staple unit 73, the movement of the first engagement member 721 between the parallel groove 761 and the first sway groove 762 and the movement of the second engagement member 722 between the parallel groove 761 and the second sway groove 763 are smooth. Thus, it is possible to reduce the load applied to the first engagement member 721, the second engagement member 722, each groove, and the like, and to prevent the occurrence of failures such as damages to them as much as possible.

As illustrated in FIG. 6, the posture control unit 76, which guides the movement of the first engagement member 721 and the second engagement member 722, further includes a first movable guide member 764 and a second movable guide member 765 provided in the first sway groove 762 and a third movable guide member 766 and a fourth movable guide member 767 provided in the second sway groove 763.

The first movable guide member 764 is rotatably provided around a first rotation shaft 7641 in the first end arc area 7621. The first movable guide member 764 is a member that controls the movement of the first engagement member 721 within the first end arc area 7621. The first movable guide member 764 rotates around the first rotation shaft 7641 to allow for the movement of the first engagement member 721 from the first end arc area 7621 to the first linear area 7622 and prevent the movement of the first engagement member 721 from the first linear area 7622 to the first end arc area 7621.

The first movable guide member 764 includes a first contact surface 7642 and a second contact surface 7643 with which the first engagement member 721 is brought into contact. The first movable guide member 764 is biased by a biasing member (not illustrated) and, during a non-movement time when the first engagement member 721 does not move in the first end arc area 7621, is in a posture such that the first contact surface 7642 is located in the first end arc area 7621 and the second contact surface 7643 faces the first linear area 7622. When the first engagement member 721 moves from the parallel groove 761 to the first end arc area 7621 so that the first engagement member 721 is brought into contact with the first contact surface 7642 of the first movable guide member 764, the first movable guide member 764 rotates around the first rotation shaft 7641 against the biasing force of the biasing member due to the pressing force of the first engagement member 721 against the first contact surface 7642 so as to allow for the movement of the first engagement member 721 from the first end arc area 7621 to the first linear area 7622. When the first engagement member 721 reaches the first linear area 7622 after moving in the first end arc area 7621, the first movable guide member 764 is reset in a posture for the non-movement time of the first engagement member 721 due to the biasing force of the biasing member. Accordingly, the first movable guide member 764 prevents the movement of the first engagement member 721 from the first linear area 7622 to the first end arc area 7621 in a state where the first engagement member 721 is in contact with the second contact surface 7643.

The second movable guide member 765 is rotatably provided around a second rotation shaft 7651 in the first intermediate arc area 7623. The second movable guide member 765 is a member that controls the movement of the first engagement member 721 within the first intermediate arc area 7623. The second movable guide member 765 rotates around the second rotation shaft 7651 to allow for the movement of the first engagement member 721 from the first intermediate arc area 7623 to the parallel groove 761 and prevent the movement of the first engagement member 721 from the parallel groove 761 to the first intermediate arc area 7623.

The second movable guide member 765 includes a third contact surface 7652 and a fourth contact surface 7653 with which the first engagement member 721 is brought into contact. The second movable guide member 765 is biased by a biasing member (not illustrated) and, during a non-movement time when the first engagement member 721 does not move in the first intermediate arc area 7623, is in a posture such that the third contact surface 7652 faces the parallel groove 761 and the fourth contact surface 7653 is located within the first intermediate arc area 7623. When the first engagement member 721 moves in the first intermediate arc area 7623 and the first engagement member 721 is brought into contact with the fourth contact surface 7653 of the second movable guide member 765, the second movable guide member 765 rotates around the second rotation shaft 7651 against the biasing force of the biasing member due to the pressing force of the first engagement member 721 against the fourth contact surface 7653 so as to allow for the movement of the first engagement member 721 from the first intermediate arc area 7623 to the parallel groove 761. When the first engagement member 721 reaches the parallel groove 761 after moving in the first intermediate arc area 7623, the second movable guide member 765 is reset in a posture for the non-movement time of the first engagement member 721 due to the biasing force of the biasing member. Accordingly, the second movable guide member 765 prevents the movement of the first engagement member 721 from the parallel groove 761 to the first intermediate arc area 7623 in a state where the first engagement member 721 is in contact with the third contact surface 7652.

The third movable guide member 766 is rotatably provided around a third rotation shaft 7661 in the second end arc area 7631. The third movable guide member 766 is a member that controls the movement of the second engagement member 722 within the second end arc area 7631. The third movable guide member 766 rotates around the third rotation shaft 7661 to allow for the movement of the second engagement member 722 from the second end arc area 7631 to the second linear area 7632 and prevent the movement of the second engagement member 722 from the second linear area 7632 to the second end arc area 7631.

The third movable guide member 766 includes a fifth contact surface 7662 and a sixth contact surface 7663 with which the second engagement member 722 is brought into contact. The third movable guide member 766 is biased by a biasing member (not illustrated) and, during a non-movement time when the second engagement member 722 does not move in the second end arc area 7631, is in a posture such that the fifth contact surface 7662 is located within the second end arc area 7631 and the sixth contact surface 7663 faces the second linear area 7632. When the second engagement member 722 moves from the parallel groove 761 to the second end arc area 7631 so that the second engagement member 722 is brought into contact with the fifth contact surface 7662 of the third movable guide member 766, the third movable guide member 766 rotates around the third rotation shaft 7661 against the biasing force of the biasing member due to the pressing force of the second engagement member 722 against the fifth contact surface 7662 so as to allow for the movement of the second engagement member 722 from the second end arc area 7631 to the second linear area 7632. When the second engagement member 722 reaches the second linear area 7632 after moving in the second end arc area 7631, the third movable guide member 766 is reset in a posture for the non-movement time of the second engagement member 722 due to the biasing force of the biasing member. Accordingly, the third movable guide member 766 prevents the movement of the second engagement member 722 from the second linear area 7632 to the second end arc area 7631 in a state where the second engagement member 722 is in contact with the sixth contact surface 7663.

The fourth movable guide member 767 is rotatably provided around a fourth rotation shaft 7671 in the second intermediate arc area 7633. The fourth movable guide member 767 is a member that controls the movement of the second engagement member 722 within the second intermediate arc area 7633. The fourth movable guide member 767 rotates around the fourth rotation shaft 7671 to allow for the movement of the second engagement member 722 from the second intermediate arc area 7633 to the parallel groove 761 and prevent the movement of the second engagement member 722 from the parallel groove 761 to the second intermediate arc area 7633.

The fourth movable guide member 767 includes a seventh contact surface 7672 and an eighth contact surface 7673 with which the second engagement member 722 is brought into contact. The fourth movable guide member 767 is biased by a biasing member (not illustrated) and, during a non-movement time when the second engagement member 722 does not move in the second intermediate arc area 7633, is in a posture such that the seventh contact surface 7672 faces the parallel groove 761 and the eighth contact surface 7673 is located within the second intermediate arc area 7633. When the second engagement member 722 moves in the second intermediate arc area 7633 and the second engagement member 722 is brought into contact with the eighth contact surface 7673 of the fourth movable guide member 767, the fourth movable guide member 767 rotates around the fourth rotation shaft 7671 against the biasing force of the biasing member due to the pressing force of the second engagement member 722 against the eighth contact surface 7673 so as to allow for the movement of the second engagement member 722 from the second intermediate arc area 7633 to the parallel groove 761. When the second engagement member 722 reaches the parallel groove 761 after moving in the second intermediate arc area 7633, the fourth movable guide member 767 is reset in a posture for the non-movement time of the second engagement member 722 due to the biasing force of the biasing member. Accordingly, the fourth movable guide member 767 prevents the movement of the second engagement member 722 from the parallel groove 761 to the second intermediate arc area 7633 in a state where the second engagement member 722 is in contact with the seventh contact surface 7672.

As described above, when the first engagement member 721 moves in the first sway groove 762 in accordance with the linear movement of the first movable body 71, the first movable guide member 764 and the second movable guide member 765 prevent the movement in each area in the reverse order so that the first engagement member 721 moves in the order from the first end arc area 7621, the first linear area 7622, and then the first intermediate arc area 7623. Further, when the second engagement member 722 moves in the second sway groove 763 in accordance with the linear movement of the first movable body 71, the third movable guide member 766 and the fourth movable guide member 767 prevent the movement in each area in the reverse order so that the second engagement member 722 moves in the order from the second end arc area 7631, the second linear area 7632, and then the second intermediate arc area 7633.

What is claimed is:

1. A post-processing apparatus comprising:

a stack unit on which sheets are stacked and aligned to form a bundle of sheets;

a base member that is arranged adjacent to the stack unit and extends in a width direction perpendicular to a conveying direction of the bundle of sheets;

a first movable body that is supported by the base member and is linearly moved along the width direction;

a second movable body that includes a first engagement member and a second engagement member and is attached to the first movable body so as to be swayed;

a staple unit that is secured to the second movable body, is moved in the width direction in accordance with a linear movement of the first movable body, is swayed due to sway of the second movable body so as to execute parallel stapling to staple the bundle of sheets stacked on the stack unit at a specific position parallel to the width direction, and is swayed at a specific angle with respect to the width direction together with the second movable body so as to execute corner stapling to staple the bundle of sheets at a corner at a tilt with respect to the width direction; and a posture control unit that is formed in the base member and is engaged with the first engagement member and the second engagement member to guide a movement of the first engagement member and the second engagement member in accordance with a linear movement of the first movable body so as to control a posture of the second movable body, wherein the posture control unit includes:

a parallel groove that extends linearly along the width direction to guide a movement of the first engagement member and the second engagement member side by side in the width direction in accordance with a linear movement of the first movable body to maintain a posture of the second movable body at a parallel posture such that the staple unit is in a posture parallel to the width direction; and a first sway groove that is formed in an arc shape from a first end of the parallel groove with respect to the width direction and having a first end arc area to guide the second movable body to a first corner stapling position so as to execute the corner stapling at a corner on a first side with respect to the width direction of the bundle of sheets, wherein the first sway groove guides the movement of the first engagement member in the first end arc area while the second engagement member moves in the parallel groove in accordance with a linear movement of the first movable body to the first side with respect to the width direction so that a posture of the second movable body is changed from the parallel posture to a first sway posture due to sway around the second engagement member in a first direction at the first corner stapling position, and the first engagement member is in constant contact with the first sway groove while the first engagement member moves in the first sway groove, wherein the first sway groove further includes a first linear area that extends linearly in the width direction from the first end arc area to guide a movement of the first engagement member while the second engagement member moves in the parallel groove in accordance with a linear movement of the first movable body to a second side with respect to the width direction so as to maintain the posture of the second movable body at the first sway posture; and a first intermediate arc area that is formed in an arc shape from the first linear area, and is connected to an intermediate portion of the parallel groove, the first intermediate arc area guiding the first engagement member from the first linear area to the parallel groove while the second engagement member moves in the parallel groove in accordance with a linear movement of the first movable body to the second side with respect to the width direction so as to return the posture of the second movable body from the first sway posture to the parallel posture, and wherein the posture control unit further includes:

a first movable guide member that is provided in the first end arc area to allow for a movement of the first engagement member from the first end arc area to the first linear area and prevent a movement of the first engagement member from the first linear area to the first end arc area; and a second movable guide member that is provided in the first intermediate arc area to allow for a movement of the first engagement member from the first intermediate arc area to the parallel groove and prevent a movement of the first engagement member from the parallel groove to the first intermediate arc area.

2. The post-processing apparatus according to claim 1, wherein the first movable body includes a first insertion hole that is formed in an arc shape that corresponds to a shape of the first end arc area so as to intersect with the width direction and through which the first engagement member is inserted, the first insertion hole guides sway of the second movable body in accordance with a movement of the first engagement member in the first end arc area, and the first engagement member is in contact with an inner peripheral edge of the first insertion hole.

3. The post-processing apparatus according to claim 1, wherein the posture control unit further includes a second sway groove that is formed in a shape axisymmetric to the first sway groove with a straight line extending through a center of the parallel groove with respect to the width direction and extending along the conveying direction as an axis of symmetry and is connected to a second end of the parallel groove with respect to the width direction, the second sway groove being formed in an arc shape from a second end of the parallel groove with respect to the width direction and having a second end arc area to guide the second movable body to a second corner stapling position so as to execute the corner stapling at a corner on a second side with respect to the width direction of the bundle of sheets, the second sway groove guides the movement of the second engagement member in the second end arc area while the first engagement member moves in the parallel groove in accordance with a linear movement of the first movable body to the second side with respect to the width direction so that the posture of the second movable body is changed from the parallel posture to a second sway posture due to sway around the first engagement member in a second direction opposite to the first direction at the second corner stapling position, and the second engagement member is in constant contact with the second sway groove while the second engagement member moves in the second sway groove.

4. The post-processing apparatus according to claim 3, wherein the second sway groove further includes a second linear area that extends linearly in the width direction from the second end arc area to guide a movement of the second engagement member while the first engagement member moves in the parallel groove in accordance with a linear movement of the first movable body to the first side with respect to the width direction so as to maintain the posture of the second movable body at the second sway posture; and a second intermediate arc area that is formed in an arc shape from the second linear area, and is connected to an intermediate portion of the parallel groove, the second intermediate arc area guiding the second engagement member from the second linear area to the parallel groove while the first engagement member moves in the parallel groove in accordance with a linear movement of the first movable body to the first side with respect to the width direction so as to return the posture of the second movable body from the second sway posture to the parallel posture.

5. The post-processing apparatus according to claim 3, wherein the first movable body includes a second insertion hole that is formed in an arc shape that corresponds to a shape of the second end arc area so as to intersect with the width direction and through which the second engagement member is inserted, and the second engagement member is in contact with an inner peripheral edge of the second insertion hole while the second engagement member moves in the second sway groove.

6. The post-processing apparatus according to claim 4, wherein the posture control unit further includes:

a third movable guide member that is provided in the second end arc area to allow for a movement of the second engagement member from the second end arc area to the second linear area and prevent a movement of the second engagement member from the second linear area to the second end arc area; and a fourth movable guide member that is provided in the second intermediate arc area to allow for a movement of the second engagement member from the second intermediate arc area to the parallel groove and prevent a movement of the second engagement member from the parallel groove to the second intermediate arc area.

7. An image forming apparatus comprising:

an image forming unit that performs image forming processing to form an image on a sheet, and the post-processing apparatus according to claim 1 that performs post-processing on a sheet having undergone the image forming processing.

8. A post-processing apparatus comprising:

a stack unit on which sheets are stacked and aligned to form a bundle of sheets;

a base member that is arranged adjacent to the stack unit and extends in a width direction perpendicular to a conveying direction of the bundle of sheets;

a first movable body that is supported by the base member and is linearly moved along the width direction;

a second movable body that includes a first engagement member and a second engagement member and is attached to the first movable body so as to be swayed;

a staple unit that is secured to the second movable body, is moved in the width direction in accordance with a linear movement of the first movable body, is swayed due to sway of the second movable body so as to execute parallel stapling to staple the bundle of sheets stacked on the stack unit at a specific position parallel to the width direction, and is swayed at a specific angle with respect to the width direction together with the second movable body so as to execute corner stapling to staple the bundle of sheets at a corner at a tilt with respect to the width direction; and a posture control unit that is formed in the base member and is engaged with the first engagement member and the second engagement member to guide a movement of the first engagement member and the second engagement member in accordance with a linear movement of the first movable body so as to control a posture of the second movable body, wherein the posture control unit includes:

a parallel groove that extends linearly along the width direction to guide a movement of the first engagement member and the second engagement member side by side in the width direction in accordance with a linear movement of the first movable body to maintain a posture of the second movable body at a parallel posture such that the staple unit is in a posture parallel to the width direction; and a first sway groove that is formed in an arc shape from a first end of the parallel groove with respect to the width direction and having a first end arc area to guide the second movable body to a first corner stapling position so as to execute the corner stapling at a corner on a first side with respect to the width direction of the bundle of sheets, wherein the first sway groove guides the movement of the first engagement member in the first end arc area while the second engagement member moves in the parallel groove in accordance with a linear movement of the first movable body to the first side with respect to the width direction so that a posture of the second movable body is changed from the parallel posture to a first sway posture due to sway around the second engagement member in a first direction at the first corner stapling position, and the first engagement member is in constant contact with the first sway groove while the first engagement member moves in the first sway groove, wherein the posture control unit further includes a second sway groove that is formed in a shape axisymmetric to the first sway groove with a straight line extending through a center of the parallel groove with respect to the width direction and extending along the conveying direction as an axis of symmetry and is connected to a second end of the parallel groove with respect to the width direction, the second sway groove being formed in an arc shape from a second end of the parallel groove with respect to the width direction and having a second end arc area to guide the second movable body to a second corner stapling position so as to execute the corner stapling at a corner on a second side with respect to the width direction of the bundle of sheets, the second sway groove guides the movement of the second engagement member in the second end arc area while the first engagement member moves in the parallel groove in accordance with a linear movement of the first movable body to the second side with respect to the width direction so that the posture of the second movable body is changed from the parallel posture to a second sway posture due to sway around the first engagement member in a second direction opposite to the first direction at the second corner stapling position, and the second engagement member is in constant contact with the second sway groove while the second engagement member moves in the second sway groove, wherein the second sway groove further includes a second linear area that extends linearly in the width direction from the second end arc area to guide a movement of the second engagement member while the first engagement member moves in the parallel groove in accordance with a linear movement of the first movable body to the first side with respect to the width direction so as to maintain the posture of the second movable body at the second sway posture; and a second intermediate arc area that is formed in an arc shape from the second linear area, and is connected to an intermediate portion of the parallel groove, the second intermediate arc area guiding the second engagement member from the second linear area to the parallel groove while the first engagement member moves in the parallel groove in accordance with a linear movement of the first movable body to the first side with respect to the width direction so as to return the posture of the second movable body from the second sway posture to the parallel posture, and wherein the posture control unit further includes:

a third movable guide member that is provided in the second end arc area to allow for a movement of the second engagement member from the second end arc area to the second linear area and prevent a movement of the second engagement member from the second linear area to the second end arc area; and a fourth movable guide member that is provided in the second intermediate arc area to allow for a movement of the second engagement member from the second intermediate arc area to the parallel groove and prevent a movement of the second engagement member from the parallel groove to the second intermediate arc area.

* * * * *